US009289677B2

(12) United States Patent
Schubert et al.

(10) Patent No.: US 9,289,677 B2
(45) **Date of Patent: *Mar. 22, 2016**

(54) MODULAR DEALING SHOE FOR CASINO TABLE CARD GAMES

(75) Inventors: Oliver M. Schubert, Las Vegas, NV (US); Attila Grauzer, Las Vegas, NV (US); Justin G. Downs, III, Henderson, NV (US); James V. Kelly, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 1487 days.

This patent is subject to a terminal disclaimer.

(21) Appl. No.: 12/221,607

(22) Filed: Aug. 4, 2008

(65) Prior Publication Data

US 2009/0054161 A1 Feb. 26, 2009

Related U.S. Application Data

(63) Continuation of application No. 10/958,208, filed on Oct. 4, 2004, now Pat. No. 7,407,438, which is a continuation-in-part of application No. 10/915,914, filed on Aug. 10, 2004, now Pat. No. 7,264,241, which (Continued)

(51) Int. Cl.
*A63F 9/24* (2006.01)
*G06F 17/00* (2006.01)
*A63F 1/14* (2006.01)

(52) U.S. Cl.
CPC ..... *A63F 1/14* (2013.01)

(58) Field of Classification Search
CPC ..... A63F 1/14; A63F 1/12
USPC ..... 463/22, 29
See application file for complete search history.

(56) References Cited

U.S. PATENT DOCUMENTS 1,831,580 A 11/1931 Stecker
2,395,138 A 2/1946 Nicholls (Continued)

FOREIGN PATENT DOCUMENTS

CN 101127131 2/2008
DE 4439502 6/1995

(Continued)

OTHER PUBLICATIONS

Press Release for Alliance Gaming Corp., Jul. 26, 2004—Alliance Gaming Announces Contract With Galaxy Macau for New MindPlay Baccarat Table Technology, http://biz.yahoo.com/prnews.

(Continued)

*Primary Examiner* — Paula A D'Agostino
(74) *Attorney, Agent, or Firm* — TraskBritt

(57) ABSTRACT

A playing card delivery shoe used in the play of the casino table card game of blackjack. The shoe may comprise: an area for receiving a first set of playing cards useful in the play of the casino table card game of blackjack; a first card mover that moves playing cards from the first set of playing cards to a playing card staging area wherein at least one playing card is staged in an order by which playing cards are removed from the first set of playing cards and moved to the playing card staging area; a second playing card mover that moves playing cards from the playing card staging area to a delivery area wherein playing cards removed from the staging area to the delivery shoe are moved in the same order by which playing cards were removed from the first set of playing cards and moved to the playing card staging area; and playing card-reading sensors that read at least one playing card value of each playing card separately after each playing card has been removed from the area for receiving the first set of playing cards and before removal from the playing card delivery area. There is a communication link between the playing card-reading sensors and a processor, and the processor analyzes the data and displays certain game-related data on a display device.

16 Claims, 4 Drawing Sheets

Related U.S. Application Data is a continuation-in-part of application No. 10/622,321, filed on Jul. 17, 2003, now Pat. No. 7,029,009, and a continuation-in-part of application No. 10/880,408, filed on Jun. 28, 2004, now abandoned, said application No. 10/958,208 is a continuation-in-part of application No. 10/880,410, filed on Jun. 28, 2004, now abandoned, and a continuation-in-part of application No. 10/880,408.

(56) References Cited

U.S. PATENT DOCUMENTS 3,222,071 A 12/1965 Lang
3,929,339 A 12/1975 Mattioli
4,457,512 A 7/1984 Stevenson
4,494,197 A 1/1985 Troy et al.
4,497,488 A 2/1985 Plevyak et al.
4,534,562 A 8/1985 Cuff et al.
4,667,959 A 5/1987 Pfeiffer et al.
4,750,743 A 6/1988 Nicoletti
4,755,941 A 7/1988 Bacchi
4,926,327 A 5/1990 Sidley
4,995,615 A 2/1991 Cheng
5,179,517 A 1/1993 Sarbin et al.
5,199,710 A 4/1993 Lamle
5,209,476 A 5/1993 Eiba
5,224,712 A 7/1993 Laughlin et al.
5,257,179 A 10/1993 DeMar
5,276,312 A 1/1994 McCarthy
5,283,422 A 2/1994 Storch et al.
5,303,921 A 4/1994 Breeding
5,356,145 A * 10/1994 Verschoor ..... 273/149 R
5,362,053 A 11/1994 Miller
5,364,104 A 11/1994 Jones et al.
5,374,061 A 12/1994 Albrecht
5,393,067 A 2/1995 Paulsen et al.
5,431,399 A 7/1995 Kelley
5,470,079 A 11/1995 LeStrange et al.
5,544,893 A 8/1996 Jones et al.
5,586,766 A 12/1996 Forte et al.
5,586,936 A 12/1996 Bennett et al.
5,605,334 A 2/1997 McCrea, Jr.
5,613,912 A 3/1997 Slater
5,655,961 A 8/1997 Acres et al.
5,669,816 A 9/1997 Garczynski et al.
5,681,039 A 10/1997 Miller
5,683,085 A 11/1997 Johnson et al.
5,722,893 A 3/1998 Hill et al.
5,735,525 A 4/1998 McCrea, Jr.
5,770,533 A 6/1998 Franchi
5,772,505 A 6/1998 Garczynski et al.
5,779,546 A 7/1998 Meissner et al.
5,781,647 A 7/1998 Fishbine et al.
5,788,574 A 8/1998 Ornstein et al.
5,803,808 A 9/1998 Strisower
5,911,626 A 6/1999 McCrea, Jr.
5,919,090 A 7/1999 Mothwurf
5,932,139 A 8/1999 Oshima et al.
5,941,769 A 8/1999 Order
5,989,122 A 11/1999 Roblejo
6,039,650 A 3/2000 Hill
6,071,190 A 6/2000 Weiss et al.
6,093,103 A 7/2000 McCrea, Jr.
6,117,012 A 9/2000 McCrea, Jr.
6,126,166 A 10/2000 Lorson et al.
6,139,014 A 10/2000 Breeding et al.
6,165,069 A 12/2000 Sines et al.
6,217,447 B1 4/2001 Lofink et al.
6,250,632 B1 6/2001 Albrecht
6,254,096 B1 7/2001 Grauzer et al.
6,267,248 B1 7/2001 Johnson
6,267,671 B1 7/2001 Hogan
6,270,404 B2 8/2001 Sines et al.
6,293,864 B1 9/2001 Romero
6,299,536 B1 10/2001 Hill
6,313,871 B1 11/2001 Schubert
6,346,044 B1 2/2002 McCrea, Jr.
6,361,044 B1 3/2002 Block et al.
6,403,908 B2 6/2002 Stardust et al.
6,446,864 B1 9/2002 Kim et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,579,180 B2 6/2003 Soltys et al.
6,579,181 B2 6/2003 Soltys et al.
6,582,301 B2 6/2003 Hill
6,582,302 B2 6/2003 Romero
6,585,586 B1 7/2003 Romero
6,588,751 B1 7/2003 Grauzer et al.
6,595,857 B2 7/2003 Soltys et al.
6,616,535 B1 9/2003 Nishizaki et al.
6,622,185 B1 9/2003 Johnson et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,652,379 B2 11/2003 Soltys et al.
6,659,460 B2 12/2003 Blaha et al.
6,663,490 B2 12/2003 Soltys et al.
6,666,768 B1 12/2003 Akers
6,685,567 B2 2/2004 Cockerille
6,685,568 B2 2/2004 Soltys et al.
6,688,979 B2 2/2004 Soltys et al.
6,698,756 B1 3/2004 Baker et al.
6,712,696 B2 3/2004 Soltys et al.
6,719,634 B2 4/2004 Mishina et al.
6,746,333 B1 6/2004 Onda et al.
6,758,751 B2 7/2004 Soltys et al.
6,758,757 B2 7/2004 Luciano, Jr. et al.
6,804,763 B1 10/2004 Stockdale et al.
7,029,009 B2 4/2006 Grauzer et al.
7,124,947 B2 10/2006 Storch
7,213,812 B2 5/2007 Schubert et al.
7,264,241 B2 9/2007 Schubert et al.
7,322,576 B2 1/2008 Grauzer et al.
7,369,161 B2 5/2008 Easwar et al.
7,374,170 B2 5/2008 Grauzer et al.
7,407,438 B2 * 8/2008 Schubert et al. ..... 463/22
7,434,805 B2 10/2008 Grauzer et al.
7,593,544 B2 9/2009 Downs, III et al.
7,699,694 B2 4/2010 Hill
7,717,427 B2 5/2010 Grauzer et al.
7,753,373 B2 7/2010 Grauzer et al.
7,769,232 B2 8/2010 Downs, III
7,933,444 B2 4/2011 Downs, III et al.
8,118,305 B2 2/2012 Grauzer et al.
2001/0036866 A1 11/2001 Stockdale et al.
2002/0107067 A1 8/2002 McGlone et al.
2002/0147042 A1 10/2002 Vuong et al.
2002/0155869 A1 10/2002 Soltys et al.
2002/0187830 A1 12/2002 Stockdale et al.
2003/0003997 A1 1/2003 Vuong et al.
2003/0054868 A1 3/2003 Paulsen et al.
2003/0195025 A1 10/2003 Hill
2004/0003395 A1 1/2004 Srinivas et al.
2004/0067789 A1 4/2004 Grauzer et al.
2004/0116179 A1 6/2004 Nicely et al.
2004/0152502 A1 8/2004 Okada
2004/0256803 A1 12/2004 Ko
2005/0012270 A1 1/2005 Schubert et al.
2005/0026680 A1 2/2005 Gururajan
2005/0082750 A1 4/2005 Grauzer et al.
2005/0119048 A1 6/2005 Soltys et al.
2005/0242500 A1 11/2005 Downs, III

(56) References Cited

U.S. PATENT DOCUMENTS

| | | | |
|---|---|---|---|
| 2005/0288083 | A1 | 12/2005 | Downs, III |
| 2005/0288084 | A1 | 12/2005 | Schubert |
| 2006/0063577 | A1 | 3/2006 | Downs et al. |
| 2006/0279040 | A1 | 12/2006 | Downs, III et al. |
| 2007/0018389 | A1 | 1/2007 | Downs, III et al. |
| 2007/0256111 | A1 | 11/2007 | Medford et al. |
| 2007/0275762 | A1 | 11/2007 | Aaltone et al. |
| 2008/0006998 | A1 | 1/2008 | Grauzer et al. |
| 2008/0037628 | A1 | 2/2008 | Boyce et al. |
| 2008/0113783 | A1 | 5/2008 | Czyzewski et al. |
| 2008/0203658 | A1 | 8/2008 | Grauzer et al. |

FOREIGN PATENT DOCUMENTS

| | | |
|---|---|---|
| GB | 2395138 | 5/2004 |
| WO | 9840136 | 9/1998 |
| WO | 9943404 | 9/1999 |
| WO | WO 00/51076 | 8/2000 |
| WO | 2008008194 | 1/2008 |

OTHER PUBLICATIONS

"Tracking the Tables", by Jack Bularsky, Casino Journal, May 2004, vol. 17, No. 5, pp. 44-47.

Supplementary European Search Report for Application No. EP 04 77 8258, Nov. 12, 2007.

International Search Report and Written Opinion of the International Searching Authority for International Application No. PCT/US04/22654, Jan. 12, 2005.

* cited by examiner

59

| P | Win Hand | D | Display Player's hand, Dealer's hand and the winning hand. | |
|---|---|---|---|---|
| 50% | | 50% | | |
| | 18 | X | 7♥J♠ | 17 |
| X | 17 | | | |
| | | | 3♦4♣2♠9♣ | 18 |
| X | 20 | | | |
| | 21 | X | | |
| X | 19 | | | |
| | 20 | X | | |
| | D-Bu | X | | |
| X | 17 | | | |
| Ticker Scroll for advertising | | | | |

DISPLAY LAYOUT

*Fig. 4*

MODULAR DEALING SHOE FOR CASINO TABLE CARD GAMES

CROSS-REFERENCE TO RELATED APPLICATIONS

This application is a continuation of U.S. patent application Ser. No. 10/958,208, filed Oct. 4, 2004, now U.S. Pat. No. 7,407,438, issued Aug. 5, 2008, which is a continuation-in-part of U.S. patent application Ser. No. 10/880,408, filed Jun. 28, 2004, now abandoned, U.S. patent application Ser. No. 10/880,410, filed Jun. 28, 2004, now abandoned, and U.S. patent application Ser. No. 10/915,914, filed Aug. 10, 2004, now U.S. Pat. No. 7,264,241, issued Sept. 4, 2007. U.S. patent application Ser. No. 10/915,914 is a continuation-in-part of U.S. patent application Ser. No. 10/880,408, filed Jun. 28, 2004, now abandoned, and U.S. patent application Ser. No. 10/622,321, filed Jul. 17, 2003, now U.S. Pat. No. 7,029,009, issued Apr. 18, 2006.

TECHNICAL FIELD

The present invention relates to the field of gaming, the field of casino table card gaming, the play of blackjack at a casino card table, and the use of equipment with processing capability in the play of casino table card games, especially blackjack or twenty-one and their variations.

BACKGROUND

Cards are ordinarily provided to players in casino table card games, either directly from a deck held in the dealer's hands or with cards removed by the dealer from a dealing shoe or dealing rack. The original dealing racks were little more than trays that supported the deck(s) of cards in a tray and allowed the dealer to individually remove the front card (with its back facing the table to hide the rank of the card) and deliver it to a player. Over the years, both stylistic and functional changes have been made to dealing shoes, which have been used for blackjack, poker, baccarat and other casino table card games.

U.S. Pat. Nos. 6,585,586; 6,582,302; and 6,293,864 to Romero describe a gaming assembly to play a variation of the game baccarat, the gaming assembly including a computer processor assembly, a display assembly and at least one user-actuatable selector assembly. The computer processor assembly is structured to generate a player's hand and a banker's hand in accordance with rules of baccarat, one of those hands being designated the user's hand. Further, the computer processor assembly is structured to determine a winning hand in accordance with the rules of baccarat, designating the user as a winner if the user's hand is also the winning hand. Additionally, the computer processor assembly is structured to monitor consecutive ones of the user's hands and to indicate a bonus payout to the user in the event that consecutive ones of the user's hands have a final number count equal to a natural nine.

The Romero patents also describe the use of computers to determine at least bonus results and to record continuing results. The specification specifically states:

"Additionally, in yet another embodiment of the present invention, an automated gaming assembly is provided so as to make the game of baccarat and preferably the above-recited variant, more accessible to the gaming public. To this end, the baccarat gaming assembly may include a computer processor assembly, a display assembly, and user actuatable selector assembly. In particular, the display assembly allows the user to readily see the progress of the game in a manner simulating a conventional game, while the actuatable selector assembly allows the user to make any necessary decisions."

"Looking to the computer processor assembly, it is structured to generate a player's hand and a banker's hand in accordance with rules of baccarat. Moreover, the computer processor assembly is also preferably structured to permit the user to elect whether their user hand is the player's hand or the banker's hand. As a result, the user may play hunches and the like to decide which hand to play. Once the hands have been designated accordingly, the computer processor assembly is further structured to add cards to the player hand and the banker hand in accordance with the conventional rules of the card game baccarat, ultimately identifying one of the hands as a winning hand. Naturally, if the winning hand is the user hand, the user is designated a winner and a corresponding payout is made. So as to further enhance the playing experience, however, the computer processor assembly is further preferably structured to keep track of consecutive ones of the user's hands, and to indicate a bonus payout to be paid to the user if a predetermined number count of nine occurs in at least two consecutive ones of the user's hands." Sensors are present above the table (not in a reading shoe) to determine the value of cards and hands.

"The camera assembly 32 and the display assembly 38 are electrically interconnected to one another as well as to an optical scanner 52 as schematically represented in FIG. 4. As set forth above, the optical scanner 52 is connected to both the camera assembly 32 and the display assembly 38 and is specifically structured and/or programmed, with the provision of a processor 54, to optically scan and/or electronically read the number count of at least one but preferably the total number count of the number of cards located in the card positioning section 26 of the specific player area 14 determined as being the banker. The electronic reading or optical scanning by the optical scanner 52 occurs by virtue of its connection to the one or more cameras of the cameras assembly 32 viewing the cards located at the card positioning section 26. Once the optical scanner 52 determines that the total number count of at least one or preferably two consecutive banker's hand is equal to a predetermined number count, the display portion 42 will begin to continuously register and display the number of consecutive hands. Once the consecutive number of hands is discontinued, the optical scanner will immediately determine such discontinuance, and the designated number 48 will revert back to zero or will go blank, as programmed, after indicating a plus payout is to be made."

U.S. Pat. No. 4,667,959 to Pfeiffer et al. describes a card apparatus having a card hopper adapted to hold from one to at least 104 cards, a card carousel having slots for holding cards, an injector for sequentially loading cards from the hopper into the carousel, output ports, ejectors for delivering cards from the carousel to any one of the output ports, and a control board and sensors, all housed in a housing. The apparatus is also capable of communicating with selectors, which are adjustable for making card selections. The injector has three rollers driven by a motor via a worm gear. A spring-loaded lever keeps cards in the hopper pressed against the first roller. The ejectors are pivotally mounted to the base of the housing beneath the carousel and comprise a roller driven by a motor via gears and a centripetal clutch. A control board keeps track of the identity of cards in each slot, card selections, and the carousel position. Cards may be ordinary playing cards or other cards with bar codes added for card identification by the apparatus.

U.S. Pat. No. 4,750,743 to Nicoletti describes the use of a mechanical card dispensing means to advance cards at least part way out of the shoe. The described invention is for a dispenser for playing cards comprising:

a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot;

card advance means contacting the trailing card and adapted to urge the stacked cards down the inclined floor;

card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and an endless belt located in the opening in the front wall for rotating the leading card contact means, the endless belt having an exterior surface securely engaging the leading card contact means and being adapted to be displaced by an operator.

U.S. Pat. No. 5,681,039 to Miller describes a device for speeding up the pace of a game of blackjack. The device is comprised of a housing having a top surface. A card reader for reading at least a portion of a playing card is located within the housing. An indicator cooperating with the card reader is provided to inform the dealer if his down card is of a desired value. There is also disclosed herein a method for increasing the speed of play in an organized game of blackjack. This device is little more than a table-mounted "no peek" system enabling reading of single cards to determine if a blackjack occurs to a dealer during a game of twenty-one. It indicates the presence of an ace or ten as the hole card in the dealer's blackjack hand.

U.S. Pat. No. 5,779,546 to Meissner describes a method and apparatus to enable a game to be played based upon a plurality of cards. An automated dealing shoe dispenses each of the cards and recognizes each card as it is dispensed. Player stations are also included. Each player station enables a player to enter a bet, request that a card be dispensed or not dispensed, and to convert each bet into a win or a loss based upon the cards, which are dispensed by the automated dealing shoe. This patent discloses card readers for the play of blackjack.

U.S. Pat. No. 5,989,122 to Roblejo relates to an apparatus for randomizing and verifying sets of playing cards. Also, the invention relates to a process of providing such an apparatus; feeding to the apparatus one or more cards, either after they have been played in a game or from an unrandomized or unverified set of cards; and manually retrieving a verified true set of cards from the apparatus. Also, the invention relates to a process of playing in a casino setting or simulated casino setting, a card game comprising providing such an apparatus, feeding unverified sets of playing cards to the apparatus, and recovering verified true sets of cards from the apparatus.

U.S. Pat. Nos. 5,605,334; 6,093,103 and 6,117,012 to McCrea disclose apparatus for use in a security system for card games. There is some disclosure relevant to smart delivery elements in shuffling equipment. There is a description, for example, of a secure game table system for monitoring each hand in a progressive live card game, the progressive live card game having at least one deck, the at least one deck having a predetermined number of cards, the secure game table system having players at a plurality of player positions and a dealer at a dealer position, the secure game table system comprising:

a shoe for holding each card from said at least one deck before being dealt by said dealer in said hand, said shoe having a detector for reading at least the value and the suit of said each card, said detector issuing a signal corresponding at least to said value and suit for said each card, a game bet sensor located near each of said plurality of player positions for sensing the presence of a game bet, when the presence of said game bet is sensed, said game bet sensor issuing a signal corresponding to said presence, a progressive bet sensor located near each of said plurality of player positions for sensing the presence of a progressive bet, when said progressive bet is sensed, said progressive bet sensor issuing a signal corresponding to said presence, a card sensor located near each of said plurality of player positions and said dealer position, said card sensor issuing a signal when a card in said hand is received at said card sensor, a game control, said game control having a memory, said game control receptive of said game bet signals from said game bet sensor at each of said plurality of player positions for storing in memory which player positions have in place a game bet, said game control receptive of said value and suit signals from said detector in said shoe for storing in said memory at least the value and suit of each card dealt from said shoe in said hand, said game control receptive of said card received signals from said card sensor at each of said plurality of player positions and said dealer position for correlating in said memory each card dealt from said shoe in game sequence to each card received at a player position having a game bet sensed, said game control receptive of said progressive bet signals from said progressive bet sensor at each of said player positions for storing in said memory which player positions have in place a progressive bet.

The patents disclose the use of the read card values for purposes such as "a card sensor located near each player position and the dealer position issues a signal for each card received. The game control receives these signals and correlates those player positions having placed a game and/or progressive bet with the received cards. The game control at each table has stored in memory the winning combinations necessary to win the progressive jackpots. Since the game control accurately stores the suit and value of each card received at a particular player position, the game control can automatically detect a winning progressive combination and issue an award signal for that player position."

U.S. Pat. No. 6,250,632 to Albrecht describes an apparatus and method for sorting cards into a predetermined sequence. One embodiment provides a deck holding area in which cards are held for presenting a card to a reading head for reading the characters on the face of the card. The apparatus also has a tray having a sequence of slots and a card-moving mechanism for moving the presented card from the deck holding area into one of the slots. The tray is connected to a tray-positioning mechanism for selectively positioning the tray to receive a card in one of the slots from the card-moving mechanism. A controller is connected to the read head, the card-moving mechanism, and the tray-positioning mechanism. The controller controls the reading of each of the cards by the read head and identifies the value of each card read, and also controls the card-moving mechanism to move each of the cards to a slot of the tray positioned by the tray-positioning mechanism according to a predetermined sequence of values. The method for sorting includes the step of providing a tray having a sequence of slots, determining a predetermined sequence of values for the cards, and reading the face of a card to determine the value of the card. The method further includes moving the read card into one of the slots of the tray. The position of the slot into which the read card is moved corresponds to the position of the value in the predetermined sequence.

U.S. Pat. No. 6,267,248 to Johnson et al. describes a collation and/or sorting apparatus for groups of articles exemplified by a sorting and/or shuffling device for playing cards. The apparatus comprises a sensor (15) to identify articles for collation and/or sorting, feeding means to feed cards from a stack (11) past the sensor (15) to a delivery means (14) adapted to deliver cards individually to a preselected one of a storing means (24) in an indexable magazine (20). A microprocessor (16) coupled to the feed means (14), delivery means (18), sensor (15) and magazine (20) determines according to a preprogrammed routine whether cards identified by sensor (15) are collated in the magazine (20) as an ordered deck of cards or a randomly ordered or "shuffled" deck.

U.S. Pat. No. 6,403,908 to Stardust et al. describes an automated method and apparatus for sequencing and/or inspecting decks of playing cards. The method and apparatus utilizes pattern recognition technology or other image comparison technology to compare one or more images of a card with memory containing known good images of a complete deck of playing cards to identify each card as it passes through the apparatus. Once the card is identified, it is temporarily stored in a location corresponding to or identified according to its position in a properly sequenced deck of playing cards. Once a full set of cards has been stored, the cards are released in proper sequence to a completed deck hopper. The method and apparatus also includes an operator interface capable of displaying a magnified version of potential defects or problem areas contained on a card, which may then be viewed by the operator on a monitor or screen and either accepted or rejected via operator input. The present invention is also capable of providing an overall wear rating for each deck of playing cards. This patent suggests identification of cards and storage of cards with the identity of the card recognized in a storage position. The cards are read and then stored in identified and recoverable positions.

U.S. Pat. No. 6,217,447 to Lofink et al. describes a method and system for generating displays related to the play of baccarat. Cards dealt to each of the banker's and player's hands are identified by scanning and data signals are generated therefrom. The card identification data signals are processed to determine the outcome of the hand. Displays in various formats to be used by bettors are created from the processed identification signals including the cards of the hand played, historical records of outcomes and the like. The display can also show bettors' expected outcomes and historical bests. Bettors can refer to the display in making betting decisions.

The cards are read between the shoe and the player positions, outside of the shoe. "Disposed between the shoe 22 and areas 24, 26 are means for identifying the cards dealt to the player and banker hands. These means are embodied as any suitable card scanner 32. Scanner 32 optically scans each card 10 as it is dealt from the shoe 22 and swiped across the scanner 32, face down. When the cards 10 include [sic, include] a bar code (not shown) on their face, which designates suit and denomination, the scanner 32 may be a laser scanner adapted to generate signals corresponding to the bar code. Preferably, to avoid the necessity of bar coding cards, the scanner 32 is of the type, which optically scans the card face and generates data signals corresponding to the optical characteristics of the face of the card. As but an example, digital camera means can be used to generate data signals, broken in picture elements, i.e., pixels, the signal strength at the locations of the individual pixels collectively corresponding to the actual appearance of the face."

U.S. Pat. No. 5,669,816 to Garczynski et al. describes a "no peek" module for announcing when a dealer has blackjack without exposing the face of the dealer's down card. The module scans a character from the dealer's face-down standard playing card, compares the result of the scan with a set of references, and identifies the down card. The module also receives input from the dealer as to the identity of the dealer's up card, and announces whether the dealer has blackjack or the hand continues. The module is designed to be mounted to a blackjack table, such that the surface of the module on which the standard playing card rests while being scanned is in the plane of the surface of the blackjack table, allowing the dealer to slide the down card across the table and onto the scanner without lifting, and potentially exposing, the card's face. The module also removes the noise generated by a casino's heat, dust, cigarette and cigar ashes, and lint from the felt of the blackjack table, during the scanning process. The module further optimizes the scan of the character on the standard playing card by controlling the light intensity emitted by the components of the module used to illuminate the character.

U.S. Pat. No. 5,772,505 to Garczynski et al. describes a dual card scanning module that announces when the symbols of a face-up standard playing card and a face-down standard playing card achieve a desired combination (a blackjack). The module has a scanner system that illuminates and scans at least a portion of a symbol of the face-up standard playing card and at least a portion of a symbol of the face-down standard playing card and stores the results thereof in a first and second array device, respectively. The module also has a guide to assist in receiving and positioning the cards, such that the face-up standard playing card is above and aligned with the face-down standard playing card. When in this position, the symbol portions of the face-up and the face-down standard playing cards can be scanned by the array devices to generate respective scanning results. The module compares the scanned results with a memory storing a plurality of references representing respective symbols of the standard playing cards to determine if the cards have achieved the desired combination.

U.S. Pat. Nos. 6,582,301, 6,039,650, and 5,722,893 to Hill describe a shoe with a card scanner, which scans indicia on a playing card as the card moves along and out of a chute by manual direction by the dealer in the normal fashion. The scanner can be one of several different types of devices, which will sense each card as it is moved downwardly and out of the shoe. A feed forward neural network is trained, using error back-propagation to recognize all possible card suits and card values sensed by the scanner. Such a neural network becomes a part of a scanning system that provides a proper reading of the cards to determine the progress of the play of the game including how the game might suffer if the game players are allowed to count cards using a card count system and perform other acts that would limit the profit margin of the casino. The shoe of the present invention is also provided with additional devices, which make it simple and easy to record data relevant to the play of the game. For instance, the shoe has means for accommodating a "customer-tracking card" or a "preferred customer card" that reads the personal information of a card holder from a magnetic stripe on the card and this information travels with the preferred customer from game to game, throughout a casino, that the customer likes to play. An LCD display can also be part of the shoe and this display can be used to enter and retrieve vital player information as deemed necessary or desirable to the customer file opened when the magnetic stripe reader reads the preferred customer card with the customer name and account number embedded within the card's magnetic stripe. Scanned information is fed to a computer for extensive analysis.

U.S. Pat. No. 6,126,166 to Lorson et al. describes a system for monitoring play of a card game between a dealer and one or more players at a playing table, comprising: (a) a card-dispensing shoe comprising one or more active card-recognition sensors positioned to generate signals corresponding to transitions between substantially light background and dark pip areas as standard playing cards are dispensed from the card-dispensing shoe, without generating a bitmap image of each dispensed standard playing card; and (b) a signal-processing subsystem. The subsystem may be adapted to: receive the transition signals generated by the active card-recognition sensors; determine, in real time and based on the transition signals, playing-card values for the dispensed standard playing cards; and determine, in real time, a current table statistical advantage/disadvantage relative to the players for playing cards remaining in the card-dispensing shoe. The system gathers information on the distribution of cards in the discard shoe from knowledge of the sequence of cards dealt during game play. When signaled, the system determines the appropriate sequence, number, and positions of the pre-shuffle plug locations of the cards in the discard shoe. The system transmits the pre-shuffle card plug information to an output device driver assembly, which actuates the desired output devices. In one implementation, the system output devices are light-emitting diodes, but any number of electric, acoustic, or mechanical devices could be utilized. The dealer plugs the card segments as directed by the system output devices and signals completion by operating the control switch discussed above. The process is repeated until the card segments are properly positioned and then the system transmits an output signal to direct the dealer to shuffle the cards. This pre-shuffle mixing technique significantly reduces the post-shuffle statistical deck variations and improves current pre-shuffle mixing practices, which are performed arbitrarily by the dealer and do not ensure adequate and consistent distribution of the card values following the shuffle. During play, the system monitors the cards received by the dealer and actuates an output device any time the dealer's first two cards consist of an ace and any ten-valued card. When the first card received by the dealer is an ace, the passive table-mounted sensor delays actuation of the output device until all players have had the opportunity to place an optional blackjack game wager commonly referred to as "insurance."

U.S. Pat. No. 5,941,769 to Order describes a device for professional use in table games of chance with playing cards and gaming chips (jettons), in particular, the game of blackjack. An automatically working apparatus is provided that will register and evaluate all phases of the run of the game automatically. This is achieved by a card shoe with an integrated device for recognition of the value of the drawn cards (3') (optical recognition device and mirroring into a CCD-image converter); photodiodes (52) arranged under the table cloth (51) in order to separately register the casino light passing through each area (53, 54) for placing the gaming chips (41) and areas (55, 56) for placing the playing cards (3) in dependence of the arrangement or movement of the jettons and playing cards on the mentioned areas; a device for automatic recognition of each bet (scanner to register the color of the jettons, or an RFID-system comprising an S/R station and jettons with integrated transponder); an EDP program created in accordance with the gaming rules to evaluate and store all data transmitted from the functional devices to the computer; and a monitor to display the run of the game and players' wins.

U.S. Pat. No. 6,299,536 to Hill and assigned to Smart Shoes, Inc. describes an optical scanner coupled to a central processing unit (CPU) that reads the value of each card dealt to each player's hand(s) and the dealer's hand as each card is dealt to a specific hand, seat or position and converts the game card value of each card dealt from the shoe to the players and the dealer of the game to a card count system value for one or more card count systems programmed into the evaluation software. The CPU also records each player's decision(s) to hit a hand, and the dealer's decision to hit or take another card when required by the rules of the game, as the hit card is removed from the shoe. The dealer uses one or more of the keyboards and LCD displays carried by the shoe to record each of the player's decisions(s) to "insure," "surrender," "stand," "double-down," or "split" a hand. When the dealer has an ace or a ten as an up-card, he/she may use one or more of the keyboards to prompt the computer system's software, since the dealer's second card, or hole card, which is dealt face down, has been scanned and the game card value thereof has been imported into the computer systems software, to instantly inform the dealer, by means of one or more of the shoe's LCDs, if his/her game cards, or hand total, constitutes a two-card "21" or blackjack. The accuracy of the data input to the evaluation software program by this means cannot be duplicated using any type of prior art or VCR recording of a twenty-one game previously played and recorded, or currently in progress.

U.S. Pat. No. 6,460,848 to Soltys et al. and assigned to MindPlay LLC describes a system that automatically monitors playing and wagering of a game, including the gaming habits of players and the performance of employees. A card deck reader automatically reads a symbol from each card in a deck of cards before a first one of the cards is removed. The symbol identifies a respective rank and suit of the card. A chip tray reader automatically images the contents of a chip tray to periodically determine the number and value of chips in the chip tray, and to compare the change in contents of the chip tray to the outcome of game play for verifying that the proper amounts have been paid out and collected. A table monitor automatically images the activity occurring at a gaming table. Periodic comparison of the images identifies wagering, as well as the appearance, removal and position of cards and other game objects on the gaming table. A drop box automatically verifies an amount and authenticity of a deposit and reconciles the deposit with a change in the contents of the chip tray. The drop box employs a variety of lighting and resolutions to image selected portions of the deposited item. The system detects prohibited playing and wagering patterns, and determines the win/lose percentage of the players and the dealer, as well as a number of other statistically relevant measures. The measurements provide automated security and real-time accounting. The measurements also provide a basis for automatically allocating complimentary player benefits. There are numerous other MindPlay LLC patents including, at this time, U.S. Pat. Nos. 6,712,696; 6,688,979; 6,685,568;

6,663,490; 6,652,379; 6,638,161; 6,595,857; 6,579,181; 6,579,180; 6,533,662; 6,533,276; 6,530,837; 6,530,836; 6,527,271; 6,520,857; 6,517,436; and 6,517,435.

WO 00/51076 and U.S. Pat. No. 6,629,894, both assigned to Dolphin Advanced Technologies Pty. Ltd., disclose a card inspection device that includes a first loading area adapted to receive one or more decks of playing cards. A drive roller is located adjacent the loading area and positioned to impinge on a card if a card were present in the loading area. The loading area has an exit through which cards are urged, one at a time, by a feed roller. A transport path extends from the loading area exit to a card accumulation area. The transport path is further defined by two pairs of transport rollers, one roller of each pair above the transport path and one roller of each pair below the transport path. A camera is located between the two pairs of transport rollers, and a processor governs the operation of a digital camera and the rollers. A printer produces a record of the device's operation based on an output of the processor, and a portion of the transport path is illuminated by one or more blue LEDs.

Each of the references identified in the Background of the Art section and the remainder of the specification, including the Cross-reference to Related Applications section, are incorporated herein by reference in their entirety as part of the enabling disclosure for such elements as apparatus, methods, hardware and software.

DISCLOSURE

A modular dealing shoe can be provided to a casino table and communicatively connected with a processor to provide playing cards to a player (and, when needed, to a dealer) and ultimately transmit information to a processor for assistance in management of casino table games and especially blackjack or Twenty-One. A preferred casino table card game playing system comprises at least one display screen and a playing card delivery shoe for use in the play of the casino table card game of blackjack from which cards may be dealt, the delivery shoe comprising:

a) an area for receiving a first set of playing cards useful in the play of the casino table card game of blackjack;

b) a first card mover that moves playing cards from the first set of playing cards to a playing card staging area, wherein at least one playing card is staged in an order by which playing cards are removed from the first set of playing cards and moved to the playing card staging area;

c) a second playing card mover that moves playing cards from the playing card staging area to a delivery area, wherein playing cards removed from the playing card staging area to the delivery shoe are moved in the same order by which playing cards were removed from the first set of playing cards and moved to the playing card staging area; and d) playing card reading sensors that read at least one playing card value of each playing card separately after each playing card has been removed from the area for receiving the first set of playing cards and before removal from the playing card delivery area;

wherein there is a communication link between the playing card reading sensors and a processor, which processor analyzes the data and displays information relating to the game on one or more display devices. The processor may be communicatively linked to at least one display screen to provide image information to be displayed on the display screen or screens.

BRIEF DESCRIPTION OF THE DRAWINGS

FIG. 4 shows a representation of a screen shot from a dealer display screen.

DETAILED DESCRIPTION OF THE INVENTION

Figure 1:
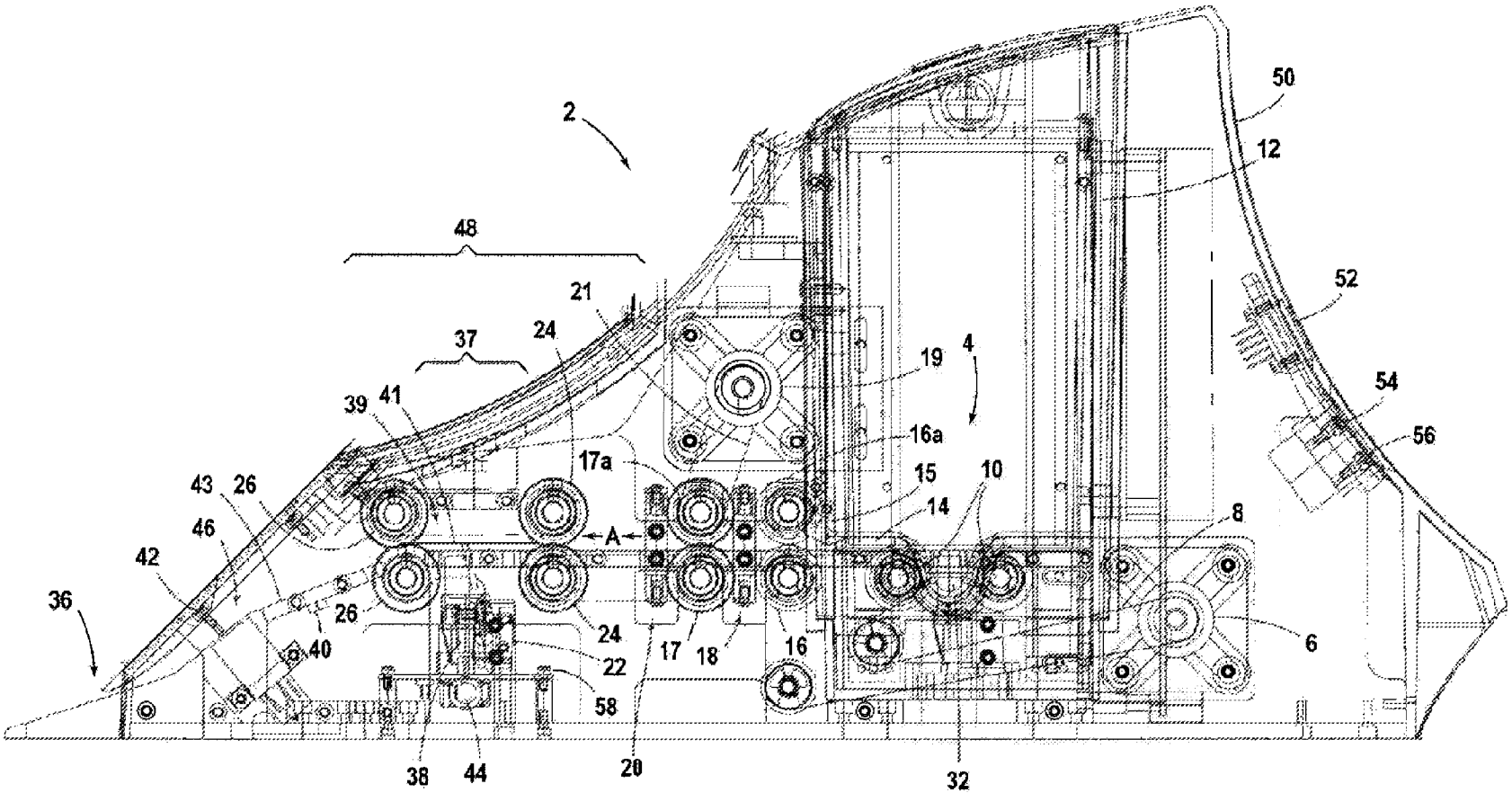
FIG. 1 shows a cutaway view of a side of a dealing shoe according to the invention.

Cards are ordinarily provided to players in casino table card games either directly from a deck held in the dealer's hands or with cards removed by the dealer from a dealing shoe or dealing rack. The original dealing racks were little more than trays that supported the deck(s) of cards in a tray and allowed the dealer to remove the front card (with its back facing the table to hide the rank of the card) and deliver it to a player. Later in time, continuous shufflers became available to casinos. One example is marketed by Shuffle Master, Inc. under the commercial name KING®. The structure and function of this shuffler is disclosed in U.S. Pat. No. 6,254,096 and the entire disclosure is hereby incorporated herein by reference. Another example is the One2six® shuffler (operating in the continuous mode), as shown and described in U.S. Pat. No. 6,659,460. The content of this patent is also incorporated herein by reference. Continuous shufflers provide a continuous stream of randomized cards to an integrally formed shoe to be used in games such as blackjack.

Card games have always been popular as wagering games. The history of card games reaches back into biblical eras. One of the most popular card games, especially for gambling or gaming uses, is the card game known as blackjack (or "21"), wherein a blackjack player plays against a dealer and the object is to beat the dealer's hand by reaching a total point value closest to 21, without exceeding a point count of twenty-one and/or by having the dealer's point count exceed twenty-one. The player may exercise strategies including adjusting his point count either by maintaining his original cards and card count (e.g., referred to as "standing," not drawing a card that might cause the blackjack player to "bust," that is, go over 21) and hope that the dealer will bust or by accepting additional cards (referred to as "hitting" or "taking a hit"), attempting to receive a cumulative point card total higher (not exceeding a total point count of 21) than the total point count that the dealer will ultimately attain. If both the blackjack player and the dealer each achieve a point count total that does not exceed 21, then the highest total (as between individual players and the dealer) wins the bet. Blackjack is relatively simple to understand and is usually a faster and easier card game to play than, for example, the game of poker; therefore, blackjack, which can be played with the dealer and only one blackjack player, tends to be more popular than the conventional game of poker, which needs to be played with several players because each of the poker players are competing against each other for one pot, whereas, each blackjack player can win against the one dealer. Even with variants of poker being played in casinos (e.g., LET IT RIDE POKER®, THREE CARD POKER®, CRAZY 4 POKER®, CARIBBEAN STUD® POKER etc.), blackjack remains the most popular card game in casinos, with many more tables usually dedicated to blackjack than to all other card games combined.

Blackjack must include a dealer (in mechanical, electromechanical, electronic or video versions of the game, a virtual dealer's hand is provided) and there must be at least one blackjack player. One or more blackjack players playing against the dealer are, in effect, individually competing to try to either obtain a better total card point count than the point count of the dealer, without exceeding a total point count in the player's hand of 21 (for the total number of multiple playing cards that they the dealer is dealt). The player may stand after receiving a minimum of two cards and hope that the dealer will bust. There are many variants on strategies that are used in the play of cards that are dependent upon a consideration of the player's cards in comparison with the dealer's cards. There are preferred and optimal strategies that may be used, with some strategies possibly influenced by card counting by the player.

For example, blackjack players seeing a dealer's exposed card as a 2, 3, 4, 5 or 6, will themselves elect to take no hits when the player's point count is 12, 13, 14, 15 or 16 in the hopes that the dealer's hitting (which is required when the dealer's point count is 16 or less) will result in a bust. The objective of the player is that with the exposed card being generally incapable of having a starting point count where the dealer may stand (the exception being a disclosed card of a 6 and a hole card of an ace), the dealer will take hits to a point total that exceeds 21 and, therefore, break (or "bust"), allowing the player to win the hand. The player will win the bet if the dealer has to hit (the dealer is required to draw if the dealer's point total is 16 or less) and the dealer busts (goes over 21). Blackjack players also have the option of splitting any pairs (i.e., a pair of cards of identical point count value, such as two face cards, a ten and a face card, a pair of tens, a pair of nines, a pair of threes, etc.). Blackjack players have several options such as to double-down (double their bet and receive only one more card), double their bet when they split a pair of cards, and can receive a 1.5 times their bet return if they receive an ace and a ten or picture card for their other card. A blackjack player receiving a card score of more than 21 points has a bust hand and automatically loses to the dealer. If the dealer accumulates cards with a point count in excess of 21, the dealer busts, and every player remaining in the game (those players who have not busted themselves) wins the hand. The dealer, after receiving the first two cards begins drawing one or more cards (if the first two cards are 16 or less), but only after each of the blackjack players at the dealer's table have played their hands to completion. Therefore, the house or casino has the advantage because the blackjack player or players must play and complete their hand first or before the dealer plays or completes his hand. The blackjack players at the table individually play against the dealer. The dealer must receive a minimum of two cards and attain a point count of at least 17 before the dealer may stop taking cards. Each of the blackjack players individually playing against the dealer (who is a representative of the house or casino) has the option of standing after the receipt of their initial two cards. This means that the player will have the options of not receiving any other cards or to draw one or more other cards from the dealer and to continue drawing cards until the player is either satisfied with their card count score and stops drawing cards (stands) or the player has busted (gone over the 21 point total). As is known in the blackjack card game, picture cards (jacks, queens and kings) each have a card point value of ten points while aces have a card point value of either one point or eleven points. The other cards, namely, twos, threes, fours, fives, sixes, sevens, eights, nines and tens, have a card point value equivalent to their card face value (i.e., respectively two, three, four, five, six, seven, eight, nine, and ten). In most gaming or casino establishments, dealers have to draw when they receive a card point value of 16 or less and, in some casinos or gaming establishments, when they receive a card point value of 17 or less where the 17 point value is based upon using an ace as an eleven-point value with one or more other cards (this is known as a soft 17).

The present dealing shoe is implemented specifically for use in the play of blackjack and provides additional functions without greatly increasing the space on the casino tabletop used by the dealing shoe. The shoe provides cards securely to a delivery area and reads the cards before they are actually nested in the card delivery area. The card-reading information is either stored locally or transferred directly to a central computer for storage and/or evaluation. The cards are mechanically transferred from a point of entry into the dealing shoe to the card delivery area, with a buffer area in the path where at least some cards are actually held for a period of time. The cards are preferably read before they are delivered into the card delivery area.

The delivery shoe, its methods and apparatus may be generally defined as a card delivery shoe having a storage end and a delivery end. The shoe stores a first set of randomized cards in the storage end and allows manual removal of cards from the delivery end. There may be at least one first sensor in the delivery end that senses when a card is absent from the delivery end. The sensor provides a signal (to some intelligence or signal-receiving apparatus) and a signal or power is provided to a motor so that a card is delivered to the delivery end. A motor mechanically delivers a card to the delivery end of the shoe as a result of the initial sensing of the absence of any card from the delivery end, especially where the card may be manually removed from the delivery end. The card delivery shoe may also have at least one sensor that reads card values in the card delivery shoe before a card that is read is stationary in the card delivery end.

An alternative way of describing other embodiments of the invention include a description as a playing card delivery shoe from which cards may be dealt comprising:

a) an area for receiving a first set of cards;

b) a first card mover that moves cards from the first set of cards to a card staging area, wherein at least one card is staged in an order by which cards are removed from the first set of cards and moved to the card staging area;

c) a second card mover that moves cards from the card staging area to a delivery area, wherein cards removed from the card staging area to the delivery shoe are moved in the same order by which cards were removed from the first set of cards and moved to the card staging area; and d) card-reading sensors that read at least one element of information of card rank, card suit or card value of each card separately after each card has been removed from the area for receiving the first set of cards and before removal from the card delivery area.

The shoe may optionally have a maximum capacity of at least one card but less than an entire deck of cards present in the staging area. Preferably, from one to two cards are present in the staging area; most preferably, only one card is present. After completion of card reading of at least one card in step d), a system of comparison may be present to compare the suit and rank of the at least one card to expected card information. Or, the value associated with the card can be taken out of the store of remaining cards in order to track the composition of the cards remaining in the shoe. The expected card information or other information may be present in a memory storage component in the shoe or external computer for each shuffled set of cards inserted in the area for receiving a shuffled set of cards. The memory storage component may also be in a central computer and read information from the shoe is relayed to the central computer for comparison. The system of comparison may be present to compare the suit and rank of the cards read in step d) with the expected card information for each shuffled set of cards inserted in the area for receiving a shuffled set of cards. The at least one information is read by the device before the card is removed from the card delivery area. Preferably, the first set of cards comprises a shuffled set of cards.

Certain aspects of the invention may alternatively be described as a card storage shoe comprising a card infeed area where an approximately vertical set of cards can be seated. The shoe could have a card-moving element that moves one card at a time from the approximately vertical set of cards. There could be an automatic mechanical transporting system for horizontally transporting individual ones of cards moved from the vertical set of cards to a card delivery area. There is preferably (but optionally) a card-reading system that reads at least one of suit, rank and value of cards before each read card becomes stationary in the card delivery area. In one embodiment, a buffer area is present between the card infeed area and the card delivery area and at least some cards remain stationary for a time in the buffer area before being delivered to the card delivery area. Cards may be read, for example, entering or while stationary in the buffer area. In one embodiment, only one card is present in the card buffer area at any time. It is one aspect of an embodiment of the invention for cards to be read in the shoe after they leave the card buffer area but before they are completely stationary in the card delivery area. They may be read when stationary in the card buffer area, but not in the card delivery area. There may be more than one sensor present along a path between the card infeed area and the card delivery area to detect the presence of cards at specific locations.

There may be design and function reasons in certain embodiments to have a sensor-reader (e.g., a camera or any other form of image detector) read cards discontinuously when the sensor-reader is triggered by a card detection sensor in the shoe.

A method is available for providing a card to a dealer for manual delivery of the cards by a dealer, the method comprising: placing a set of cards within a card infeed area; mechanically moving cards from the set of cards from the card infeed area to a card delivery area where at least some cards become stationary; and reading individual cards for at least one of rank, suit or value after the cards are removed from the card infeed area and before the cards become stationary in the card delivery area.

The method may require placing the set of cards in an approximately vertical stack in the card infeed area. At least one card from the set of cards may be moved to a buffer area between the infeed area and the card delivery area, and at least one card may remain stationary within the buffer area until the card delivery area is sensed to be empty of cards. The at least one card that remains stationary in a buffer area may remain in the buffer area until a signal generated from the shoe indicates that at least one card is to be moved from the buffer area to the card delivery area. The method may be generated by a sensor in the card delivery area indicating that an additional card is desired in the card delivery area. The signal may be generated by a sensor in the card delivery area indicating that no cards are present in the card delivery area.

The above structures, materials and physical arrangements are exemplary and are not intended to be limiting. Angles and positions in the displayed designs and figures may be varied according to the design and skill of the artisan. Travel paths of the cards need not be precisely horizontal from the card input area to the delivery area of the shoe, but may be slightly angled upwardly, downwardly or varied across the path from the card input area to the card delivery area. The cards may be sensed and/or read within the shoe while they are moving or when they are still at a particular location within the shoe.

Among the features that describe some of the fundamental apparatus that may be included within designs of the present descriptions, in conjunction with the blackjack functionality described in greater detail above, may be at least the following elements:

1) A distinct dealer shoe that has no shuffling capability.
2) Shuffled cards are inserted into the shoe for dealing.
3) The shoe mechanically feeds the cards to the dealer-accessible opening.
4) An intermediate number of cards are positioned in a buffer area between the input area and the removal area to increase the overall speed of card feed with reading to the dealer.
5) Sensors indicate when the dealer-accessible area is empty and cards are fed from the buffer zone and read one at a time.
6) The separate reading shoe is provided as present reading systems are too large to easily fit into existing shuffler structures.
7) Information relating to at least one of rank and suit of each card is preferably date stamped and sent to a data repository, either directly or via a network connection.

One set of individual and/or collective primary purposes of the blackjack content of the dealing shoe is to enable:

1) The shoe to read the cards, preferably within the buffer area of the shoe.
2) The information (rank) relating to the cards read by the dealing shoe are provided to a processor, either directly or after date stamping.
3) Information relating to the cards remaining in the shoe can be determined and displayed to casino personnel on a display out of the view of the players.
4) Other information, such as the player's cumulative point count, hitting instructions, other game rules, etc., can be displayed on a display device in view of the players.
5) The data from the dealing shoe is transferred and processed in real time.

Reference to the figures will help in an appreciation of the nature and structure of one embodiment of the card delivery shoe of the system technology described in reference to the claimed invention that is within the generic practice of the claims and enables practice of the claims in this application. FIG. 1 shows a card delivery shoe 2 according to the presently described technology and invention. The card delivery shoe 2 has a card infeed area or card input area 4, which is between a belt-driving motor 6 and a rear panel 12 of the card delivery shoe 2. The belt-driving motor 6 drives a belt 8 that engages pick-off rollers 10. These pick-off rollers 10 pick off and move individual cards from within the card infeed area 4. The belt-driving motor 6 is shown but other motor types such as gear drives, axle drives, magnetic drives and the like may be alternatively used. The pick-off rollers 10 drive individual playing cards (not shown) into gap 14 having a deflector plate 15 to direct cards individually through the gap 14 to engage brake rollers 16. The brake rollers 16 control the movement of individual cards past the rear panel 12 and into a card staging area 34. The brake rollers 16 are capable of becoming free-turning rollers during a card jam recovery process so that little or no tension is placed on a card as it is being moved by the system or manually to free a jam. A simple gear release or clutch release can effect this function. Speed-up rollers 17 apply tension to a card to move it more deeply into the card staging area 34. The speed-up rollers 17 can, and may, turn faster than the brake rollers 16, and the speed-up rollers 17 may be driven by a separate motor 19 and belt drive 21. A card path and direction of movement A is shown through the card storage area 34. As individual cards are passed along the card path A through the card storage area 34, there are card presence sensors 18, 20, and 22 located at various intervals and positions to detect the presence of cards to assure passage of cards and/or to detect stalled or jammed cards. The path A through the card storage area 34 is, in part, defined by speed-up rollers 17 or rear guide rollers 24 and forward guide rollers 26, which follow the brake rollers 16 and the speed-up rollers 17. One form of a buffer area 48 is established by the storing of cards along card path A. As cards are withdrawn from the delivery end 36 of the delivery shoe 2, additional cards are fed from the buffer area 48 into the card feed chute 46 into the delivery end 36.

It is always possible for cards to jam, misalign or stick during internal movement of cards through the dealing shoe. There are a number of mechanisms that can be used to effect jam recovery. The jam recovery may be based upon an identified (sensed) position of a jam or may be an automated sequence of events. Where a card jam recovery is specifically identified by the sensed position of a jammed card in the device (and even the number of cards jammed may be estimated by the dimensions of the sensed image), a jam recovery procedure may be initiated at that specific location. A specific location in FIG. 1 within the dealing shoe (e.g., between and inclusive of rollers 16 and 17) will be discussed from an exemplary perspective, but the discussion relates to all other positions within the device.

If a card is sensed (e.g., by sensors 18 and/or 20) as jammed between rollers 16 and 17 (e.g., a jam occurs when cards will not move out of the position between the rollers and cards refuse to be fed into that area), one of a various number of procedures may be initiated to recover or remove the jam. Among the various procedures that are discussed, by way of non-limiting example, include at least the following. The rear-most set of rollers 16 and 16*a* may reverse direction (e.g., 16 begins to turn clockwise and 16*a* begins to turn counter-clockwise) to remove the jammed card from between the rollers 16 and 16*a* and have the card extend backwards into the gap 14, without attempting to reinsert a card into the card infeed area 4. The reversed rotation may be limited to assure that the card remains in contact with the rollers 16 and 16*a*, so that the card can be moved back into progression through the dealing shoe. An optional part of this reversal can include allowing rollers 17 and 17*a* to become free rolling to release contact and tension on the card during the reversal. The reversed rotation may be smoothly run or episodic, attempting to jerk a jammed card from its jammed position. If that procedure does not work, or as an alternative procedure, both sets of rollers 16 and 17 may reverse at the same time or in either sequence (e.g., roller set 16 first or roller set 17 first) to attempt to free the jam. When one set of rollers only is turning, it is likely to be desirable to have the other set of rollers in the area of the jam to become free rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers (e.g., 16, 16*a* and 17, 17*a*) can act in coordination, in sequence, in tandem, in order, independently or in any predefined manner. For example, referring to the roller sets (e.g., rollers 16, 16*a* and 17, 17*a*) as 16 and 17, the recovery process may have the rollers act as a) roller sets 16 and 17 at the same time in the same direction, b) roller sets 16 and 17 at the same time in the opposite directions to assist in straightening out cards, c) roller set 16 and then roller set 17 to have the rollers work sequentially, d) roller set 17 and then roller set 16 to have the rollers work in a different sequence, e) roller set 16 only for an extended time, and then roller set 17 operating alone or together with roller set 16, f) roller set 17 only for an extended time or extended number of individual attempts and then roller set 16 for a prescribed time, etc. As noted earlier, a non-active roller (one that is not attempting to drive or align cards) may become free rolling during operation of another roller.

These various programs may be performed at a single jam location in series or only a single program for jam recovery may be effected. In addition, as the card may have been read at the point of the jam or before the jam, the rank and value of the card jammed may be identified and this can be displayed on the display panel on the dealing shoe (viewable by the dealer), on the central computer or on a shuffler connected to the dealing shoe, and the dealer or pit boss may examine that specific card to make certain that no markings or damage has occurred on that card that could either cause further problems with the dealing shoe or shuffler or could enable the card to be identified when it is in the dealing position in the shoe at a later time. The pit crew can then correct any problem by replacement of that specific card, which would minimize down time at the card table. Also, with these various programs, if a jam cannot be recovered, the delivery shoe would indicate a jam recovery failure (e.g., by a special light or alphanumeric display) and the pit crew would open the device and remove the jam manually.

Electronic Cut Card—This is a feature provided by software in the programming of the system. This is not a physical card that is in the shoe. Instead, the software program generates a virtual card or an "electronic cut card position" that acts like a real cut card when delivering cards. After the cut card is electronically generated and the virtual position of the card cut determined in the real card deck, the playing cards are dealt until the card cut position (a position determined after a card, between cards, before cards, or at a specific card acting as the cut card) is reached. When that electronic card cut position is reached, the shoe will alert the dealer (either with an audible signal such as a bell or buzzer, or a visual indication on the shoe display), and the dealer will typically finish delivering the last round of cards. Then the cards will be replaced with a new group of multiple decks of shuffled cards. As soon as the cut card is reached or passed, an optional light indication provides a signal or audible alarm to the dealer that the cut card has been reached, passed, dealt, or exposed as the next card (which in certain casino practices stops the deal from that shoe). The position of the cut can be generated randomly in a variety of ways. For example, a cut card location can be identified using a random number generator, with parameters selected (such as greater than 0.5 of all cards present and fewer than 0.75 of all cards present) or at a fixed value, for example, of about 35 cards for each 52 card deck present in the shoe.

Stop Card Delivery State—This is also an optional feature. It can be disabled or enabled during initial configuration. The shoe stops delivering whenever certain security-compromising events occur in the use of the shoe. By way of non-limiting example, events such as when the back door of the shoe is open, when an inaccurate card count occurs, when excess cards are found, when a deficiency of cards is found, or when there is a misdeal, can initiate a "stop card delivery state" automatically in the shoe. During this delay, a sound alert and/or visual alert may triggered. The dealer or user may be required to either press the continue button or swipe an authorization card, or do both, to continue or to restart the blackjack dealing shoe.

In the case of door opening: There may be a security device on or near the door, such as a small magnetically sensitive electric sensor on the shoe that senses when the door is open. This sensor is communicatively connected to the microprocessor that is inside of the shoe and sends a "door open" signal (e.g., a status signal) to either an internal or an external processor, such as a game table processor, pit processor, central processor or an external mini PC. When the processor (such as the external mini PC) receives this signal, it commands the shoe to stop delivering cards until it receives a "continue" command. Many other security devices are contemplated, such as a lock and the use of a special key to access the door, for example.

The dealing shoe of the present invention can also be used as a deck verification device. After the dealer receives an indication of a cut card and completes the last round of play, the house rules may require the dealer to individually remove the remaining cards (behind the virtual cut card), scanning the cards as they are removed. An indication that the group of cards is complete, or incomplete, or includes extra cards can be provided to the house, the dealer, security personnel, or all of the above.

The shoe may also be in communication with a deck verification device such as the device described in U.S. patent application Ser. No. 10/954,029, filed on Sep. 29, 2004, now U.S. Pat. No. 7,753,373, issued Jul. 13, 2010, the contents of which are hereby incorporated herein by reference. At the conclusion of verification, a special security code number may be associated with the verified group of cards removed from the deck verification device. This code may be associated with a scannable code number on the group of cards. When the group of cards is placed in the shoe, the code number is scanned, and if a signal corresponding to the verified group of cards does not match a dealer-input security code, the stop card delivery state in the shoe will be activated.

In the case of a misdeal: The system is able to detect misdeals from a number of different events that are sensed, measured or detected in the operation of the shoe. When the processor, such as the mini PC, receives the "misdealt" or "misdeal" signal, the processor commands the shoe to stop dealing, or if the shoe responds to a status signal, upon receipt of this status signal, the shoe will self-initiate a "stop deal" event. The shoe may require the same restart method to continue dealing as described above for the door-opening event.

When the blackjack shoe stops dealing cards for any of these reasons, all of the data that has been generated at that time will remain in the memory. The "stop deal" event is not a "reset" type of event, but rather is an "interrupt" or delay event, where all information and status remains current and collective.

Supervisor Swipe Card—This event is also an optional feature that can be disabled or enabled during initial configuration. When the shoe is in the "stop card delivery routine" or stop deal routine, a special card is required to swipe through the system in order to continue delivering cards. This card contains information that is needed to trigger the processor such as the mini PC to send a "continue to deal" signal to the shoe, and it may be a similar apparatus to that used by a dealer ID module that is used in intelligent table systems, and provide information by magnetic, optical, bar code, or other readable information fed into the module's scanner or reader. The information is sent to the processor, such as the external mini PC, which provides a signal or command that triggers the shoe to continue dealing. In other examples of the invention, a processor internal to the shoe controls all functions. Usually, only casino supervisors have access to the swipe card for security purposes.

A Light Indication Feature—Previously, there were three colors that had been used by the applicants to indicate the game status or results. Those colors were yellow, green and red. Because some colors are considered unlucky in some cultures, it has been decided to provide a choice of light colors for the visual displays. This feature allows users (casinos) to select different colors on site (when configuring the shoe for local casinos) to indicate important information, such as the presence of the cut card, or a light visible to only the dealer or house, that the composition of the shoe favors the player, for example. The available colors are at least red, blue, green, yellow and orange. In general, the shoe is configurable so that it is easy to add different features to fit different specifications, which offer more flexibility to customers.

Individual playing cards (not shown) may be read at one or more various locations within the card delivery shoe 2. The ability to provide multiple read locations assures performance of the shoe, while other card delivery trays with read capability usually had a single reading position at the point where and when cards were removed from the shoe for delivery to players. For example, in the construction shown in FIG. 1, the card presence sensors 18, 20 and 22 may also have card-reading capabilities, and other card-reading sensors 32, 40 and 42 may be present as card-reading elements 32, 40 and 42. Card-reading element 38 may, optionally, be present as another sensing element or a card value- (and possibly suit-) reading element without the presence of sensor 22 or in combination with sensor 22. When the sensor 38 functions as a card-reading element, it should read the cards as they are positioned into the card pre-delivery area or card buffer area 37, rather than as the cards are removed from the card delivery end 36. Information may be read by the card-reading sensor 38 by either continuous reading of all image data in the card pre-delivery area 37 or by triggering on/off imaging of data in a specific region of cards 39 as a card 41 is within the card pre-delivery area 37. For example, card presence sensor 22 may activate sensor 38. The sensor 38 is preferably a camera. A light source (not shown) may be provided to enhance the signal to the sensor 38. That specific region of cards is preferably a corner of the card 41, wherein complete value information (and possibly suit information) is readable on the card, such as a corner with value and suit ranging symbols on the card. That region could also be the entire face of the card, or at least ½ of the card (divided lengthwise). By increasing the area of the region read, more processing and memory is required, but accuracy is also increased. Accuracy could also be increased, by reading the upper right-hand corner of the card and lower left-hand corner, since both of those locations contain the rank and suit of the card. By reading two locations on the card, defects or dirt on the card can be circumvented. By using on-off or single-shot imaging of each card 41, the data flow from the sensor/card-reading element 38 is minimized and the need for larger memory and data transmission capability is reduced in the system. Information may be transferred from the card-reading elements (e.g., 38) from a communication port or wire 44 shown for sensor/reading element 38. Cards may be buffered or staged at various points within the card delivery shoe 2, such as where restrained by rollers 26 so that cards partially extend toward the chute 46 past the rollers 26 on plate 43, or staged between rollers 24 and 26, between rollers 17 and 24, or between rollers 16 and 17, and the like. Cards 41 may partially overlap in the card buffer area 37 as long as two or more cards are not present between a single set of nip rollers (e.g., 26 and 17) where nip forces may drive both cards forward at the same time.

Other variations are available to a person skilled in the art. For example, rear panel 12 may have a display panel thereon for displaying information or data, particularly to the dealer (which information would be shielded from players as the rear panel 12 would primarily face the dealer and be shielded from a players' view. A display could also be provided at a distal location for viewing by casino management.

Certain information may be of interest to a casino manager but should not be made available to players. Examples include the running count, true count and house advantage for cards remaining in the shoe. Also, an alert feature (audible or on the display) might be desirable to alert management that the remaining deck favors the player, or that the dealer has dealt one or more rounds past a cut card. For this reason, it is desirable in one example of the invention to provide multiple displays, one for the dealer, one for management, and one for the players.

A more ergonomic and aesthetic rear surface 50 is shown having a display 52 on the shoe itself that is capable of providing alphanumeric (letters and numbers) or analog or digital images of shapes and figures in black-and-white or other color. For example, the display may give messages as to the state of the shoe, time to number of cards dealt, the number of deals left before a cut card or virtual cut card is reached (e.g., the dealing shoe identifies that two decks are present, makes a virtual cut at 60 cards, and based on data input of the number of players at the table, identifies when the next deal will be the last deal with the cards in the shoe), identify any problems with the shoe (e.g., low power, card jam, where a card is jammed, misalignment of cards by rollers, and failed element such as a sensor), player hands, card rank/suit dispensed, and the like. Also on the rear surface 50 are two lights 54 and 56, which are used to show that the shoe is ready for dealing (e.g., 54 is a green light) or that there is a problem with the dealing capability of the shoe (e.g., 56 is a red light). The memory board 58 for the card-reading sensor 38 is shown with its communication port or wire 44 shown.

The invention preferably includes a display viewable by the house, but not the players. The display panel may be any panel that can conveniently provide alphanumeric data on it, and is preferably viewable by management and/or the dealer only. The screen display can be configured or tailored by the user with software that is provided in the processor. By way of a non-limiting example, the reader board is presently provided as a 19- or 21-inch (measured diagonally) plasma screen (although CRT, LED, semiconductor, Liquid Crystal or other display would be satisfactory) that is connected to the external mini PC of the card-reading shoe via a serial port. There must be a communication network (either hardwire or wireless) between electronically communicating components, or a less preferable construction would require the components to be individually hardwired to a central computer. Because the technology of the card-reading blackjack shoe disclosed herein and in U.S. Pat. No. 7,753,373 described above, from which priority is claimed, and which are incorporated herein by reference, the external mini PC has the capabilities of reconstructing the hands and determining the outcome of each round after the round is played. In particular, it would be desirable to provide a card-reading discard rack as disclosed in U.S. patent application Ser. No. 10/954,029, filed Sep. 29, 2004, now U.S. Pat. No. 7,753,373, issued Jul. 13, 2010, the contents of which are hereby incorporated herein by reference. By combining data streams from a round counter, an intelligent shoe (or intelligent shuffler) and a discard rack that reads cards, the composition of blackjack hands can be inferred.

The intelligent blackjack shoe (in combination with other modules) can generate a time- or date-stamped log or record that contains critical information such as the composition of a player's initial hand, dealer's initial hand and, without additional modules, the number of aces delivered and/or number of aces remaining in the shoe, a number of ten value cards dealt and/or number of ten value cards remaining in the shoe and, with the help of other modules, rounds of play dealt (in reference to a time period or shift, or dealer, or shoe, etc.), hands of play, hands per round, final hand composition of player and dealer, the game outcome, and/or the history of such records. This information may be sent out (e.g., from the mini PC) and displayed on the display screen, e.g., a plasma screen, viewable by the house. Certain information, such as game outcome, final hand count, an indication of a win or loss, an indication of a bonus win, etc., can be displayed on a player-viewable display. The dealer's hand count (except for the up card) will be delayed until all player hands have been concluded. This may be signaled by either a dealer input to the delivery shoe (e.g., a button, touch screen or panel entry, or even a voice command) or by some event at the table that triggers an awareness that all player hands have been completed, such as monitoring the movement of the dealer's cards with a dealer hand monitor, so that after initial delivery of the cards to the dealer that covered a dealer card module or sensor, and the subsequent removal of the cards from the sensed area would indicate that the dealer's cards are now subject to play and that the player hands have been completed. The amount of the delay time in displaying the player cards only is more controllably variable upon user's requests that can be input into the processor. A control screen with touch screen, mouse, panel, keyboard or other input can be provided to set the amount of delay, and whether or not there will be a delay. The control panel (which can be displayed on the display screen to enhance user friendliness) can accept input for stylizing the display, adjusting the content of the information (e.g., show card suits or display card values only), provide instructions to the dealer on required or disallowed activity, show a record of the hand activity (e.g., percentages of player hand wins, dealer hand wins, ties, blackjack frequency, proportion of double-down successes, proportion of split hands won, percentage of dealer hands busted, ongoing streaks of hand wins, specific time history of hand round history, etc.).

The display panel provides dealer action or player action signals with an option for highlighting of the actions on the display screen. For example, because the rules of play of blackjack are so well defined and there are few options once specific elections in play have been made (e.g., a single hit with a double-down, a single hit on split aces, cards collected when a hand busts, etc.), there are limits in the optional play in the delivery of the cards. The rules of blackjack can be programmed into the processor of the mini PC with certainty on the limits of play based upon the cards provided to the players and the dealer and revealed to the processor. When the initial two dealer cards and initial two player cards have been dealt and revealed upon the display screen viewable by players, the processor program might identify the next steps to be taken in the game. For example, the display screen might show standard hit/stand rules to assist the player. If the player elects to receive at least a next card (e.g., especially if the player hand count is 11 or lower and the dealer does not have a blackjack), the player's hand may be highlighted on the display screen (e.g., flashing numbers, specific coloration of the words "player" or "player's hand," audio information such as "deal to player!" or other audible or visible indications on the display screen or any associated speakers) or the dealer's hand is highlighted on the display screen after all player hand play has concluded or if the dealer has a blackjack. There may be a small delay on changes in the screen to allow the players to assess events, such as when the player's hand is revealed and either a hit is required or possibly desired, or no hit is allowed (because of a player's or dealer's blackjack in the two-card hand), and/or the dealer must take a hit. The delays are added to provide a period of appreciation for the play of the game rather than processing hands so rapidly the system would operate as does a video gaming device during tournament play, with rapid turnover of the games, but no individual game appreciation.

Written (alphanumeric) descriptions of events may also be provided on the screen. For example, the words "player blackjack," "player breaks," "dealer blackjack," "dealer busts," "push" or "tie," with the winning or tying hands provided on the display screen. The winner may be indicated by a display of "player win" or "dealer win" or "tie" displayed. The individual player positions may be viewed on the display panel, with even names or number of position indicated.

FIG. 4 shows a sample of a simple house display screen format. On the left of the screen is shown the recent game tracking of P (player wins), D (dealer wins), winning hand point count, their recent sequence and advertisements. On the house display, statistics such as intervals of play, an ongoing history of percentage analysis, shift history, week history, etc., may be displayed. The display may be format static during play, or the dealer/house may easily change the display (semi-permanently or temporarily). For player displays, the ability to reformat them at the request of a patron can provide increased player entertainment and discussion at the table, while enabling the casino to better track events at the table. It can also provide information that can stimulate wagering by providing information that players could believe provide them with a better judge of future events.

The house display may show a history of the hands played and the count of the hands (both the true count and a running count during play). Suits may or may not be displayed, as suits are immaterial to normal blackjack play. The system may also be programmed for player displays that are compatible with or enhance bonus events, jackpot events, or alternative blackjack rules and features in blackjack-type or blackjack-derivative games (such as THREE CARD POKER® on the first three displayed cards in the game of blackjack, a FOUR CARD POKER™ game wager on the dealer's and player's initial four cards, up to a FOUR CARD POKER™ game hand for a total count of up to six cards in the play of the game of blackjack (e.g., three player cards and three dealer cards, or a separate hand from discards or from extra cards)). All of the desired information, including poker hand determination and payouts, can be displayed on any of the display screens, as directed by the casino.

A lower panel or segment of the panel on the display screen can provide streaming video for informational or advertising purposes (where FIG. 4 shows "Ticker Display for Advertising."). Various formats and types of information can be provided including, but not limited to, advertising (especially for casino events and facilities), specific player announcements (e.g., Mr. Dunn, "Dinner Reservation at La Maison in 10 Minutes"), sports scores, desk service call to patron, and the like.

The system also may include an extra button on the device that acts like a signal control. The game information will not be displayed until the button has been pressed, therefore, the dealer can decide when is the best time to display game result.

There are significant technical and ergonomic advantages to the present structure of the blackjack shoe that is used in conjunction with the display screen and program for information display. By having the card infeed area 4 provide the cards in at least a relatively vertical stack (e.g., with less than a 60° slope of the edges of the cards away from horizontal), length of the delivery shoe 2 is reduced to enable the motor-driven delivery and card-reading capability of the shoe in a moderate space. No other card delivery shoes are known to combine vertical card infeed, horizontal (or an approximately horizontal ±40° slope or ±30° slope away from horizontal) card movement from the infeed area to the delivery area, with mechanized delivery between infeed and delivery. A motor-driven feed from the vertical infeed also reduces the need for dealers to have to jiggle the card tray to keep cards from jamming, slipping to undesirable angles on the chutes, and otherwise having to manually adjust the infeed cards, which can lead to card spillage or exposure as well as delaying the game.

Figure 2:
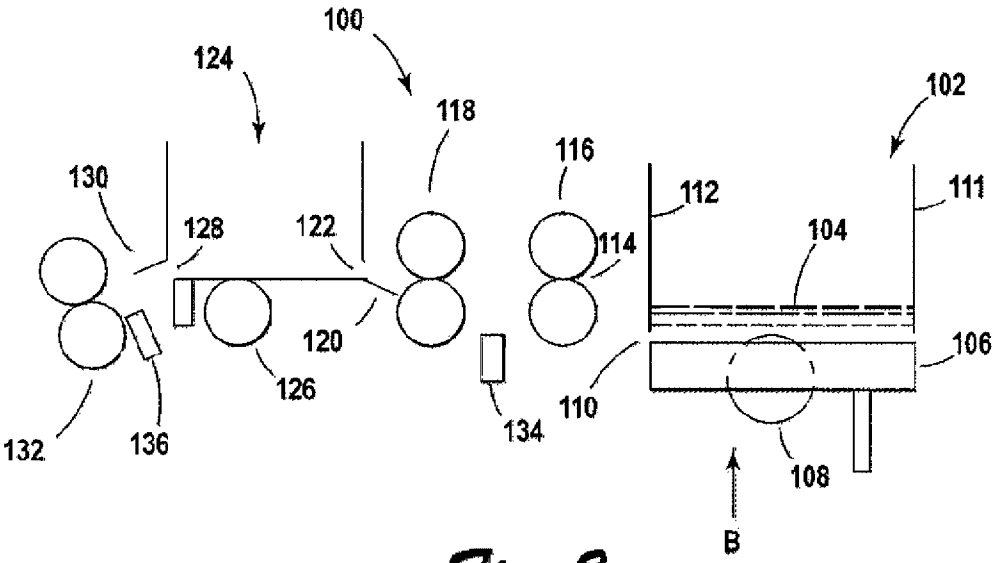
FIG. 2 shows a schematic section view of a dealing shoe with a card reading and buffer area.

FIG. 2 shows an alternative embodiment for internal card buffering and card-moving elements of a card delivery tray 100. A card infeed area 102 is provided for cards 104 that sit between walls 111 and 112 on an elevator or stationary plate 106, which moves vertically along path B. A pick-off roller 108 drives cards one at a time from the bottom of the stack of cards 104 through opening 110, which is spaced to allow only one card at a time to pass through the opening 110. Individual cards 104 are fed into a nip area 114 of a first set of speed control or guide rollers 116 and then into a second set of speed control or guide rollers 118. The cards passing through rollers 118 (one at a time) are shown to deflect against plate 120 so that cards flare up as they pass into opening 122 and will overlay any cards (not shown) in card buffer area 124. A second pick-off roller 126 is shown within the card buffer area 124 to drive cards one at a time through opening 128. The individual cards are again deflected by a plate 130 to pass into guide rollers 132, which propel the cards into a card delivery area (not shown) similar to the card delivery area 36 in FIG. 1. Card-reading elements may be positioned at any convenient point within the card delivery tray 100 shown in FIG. 2, with card-reading elements 134 and 136 shown as exemplary convenient locations.

Figure 3:
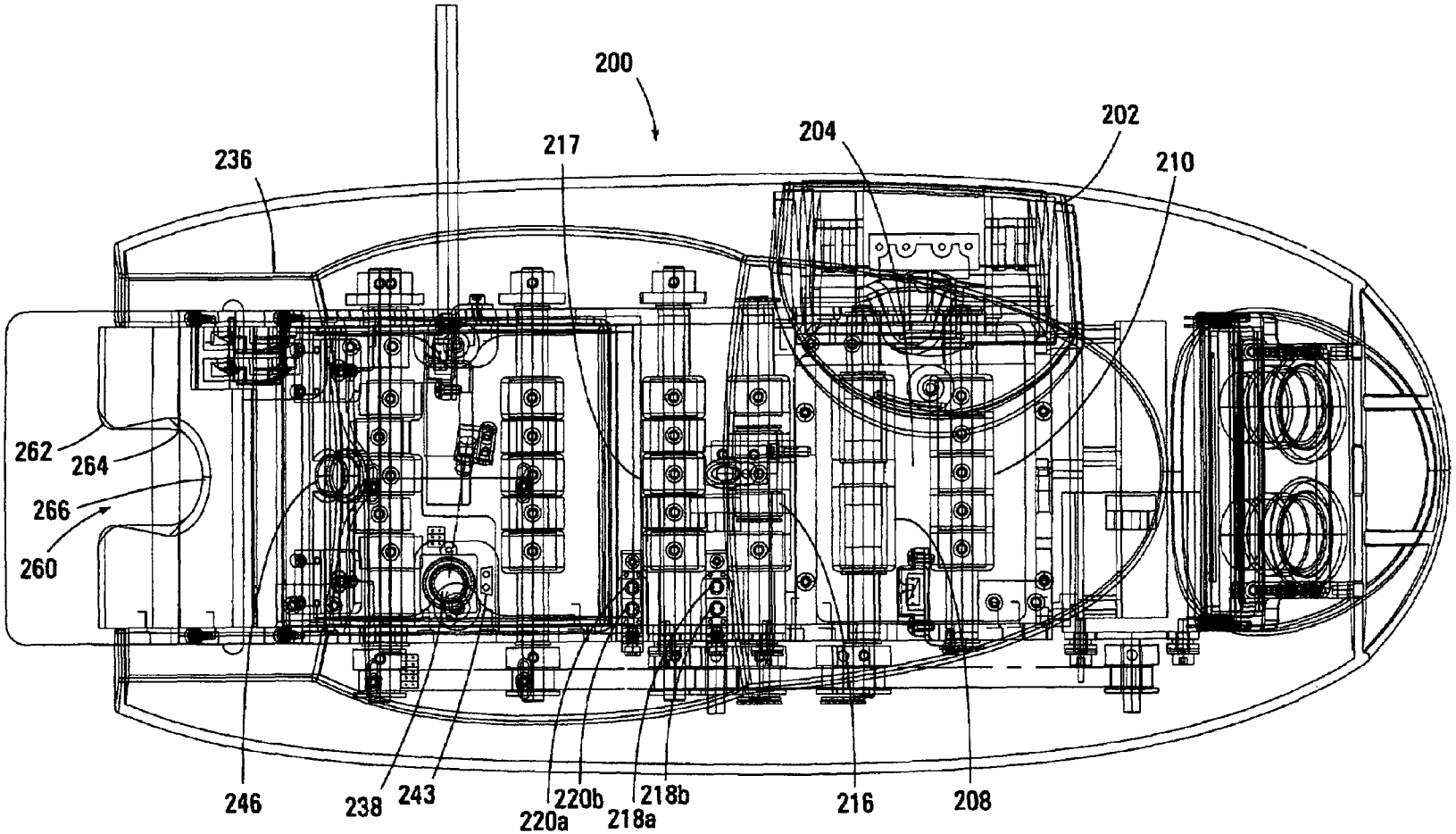
FIG. 3 shows a top cutaway view of one embodiment of the dealing shoe of FIG. 1 according to the present invention.

FIG. 3 shows a top cutaway view of the dealing shoe 200 of an embodiment of the present invention. A flip-down door 202 allows cards to be manually inserted into a card input area 204. Sets of pick-off rollers 208 and 210 are shown in the card input area 204. The position of the sensors 218*a*, 218*b* and 220*a*, 220*b* are shown outwardly from the sets of five brake rollers 216 and five speed-up rollers 217. The sensors are shown as sets of two, which is an optional construction and single sensors may be used. The dual set of sensors (as in sensors 220*a* and 220*b*) is provided with the outermost sensor 220*b* simply providing card presence sensing ability and the innermost sensor 220*a* reads the presence of the card to trigger operation of the camera card-reading sensor 238 that reads at least the value, and, optionally, the rank and suit of cards. Alternatively, the sensor 220*a* may be a single sensor used as a trigger to time the image sensing or card reading performed by camera 238, as well as sensing the presence of a card. An LED light panel 243 or other light-providing system is shown present as a clearly optional feature. A sensor 246 at the card removal end or card delivery area 236 of the shoe 200 is provided. The finger slot 260 is shown at the card delivery area 236 of the shoe 200. A lowest portion 262 of the finger slot 260 is narrower than a top portion 264 of the finger slot 260. Walls 266 may also be sloped inwardly to the shoe 200 and outwardly toward the opening 260 to provide an ergonomic feature to the finger slot 260.

The term "camera" is intended to have its broadest meaning to include any component that accepts radiation (including visible radiation, infrared, ultraviolet, etc.) and provides a signal based on variations of the radiation received. This can be an analog camera or a digital camera with a decoder or receiver that converts the received radiation into signals that can be analyzed with respect to image content. The signals may reflect either color or black-and-white information or merely measure shifts in color density and pattern. Area detectors, semiconductor converters, optical fiber transmitters to sensors or the like may be used. Any convenient software may be used that can convert radiation signals to information that can identify the suit/rank of a card from the received signal. The term "camera" is not intended to be limited in the underlying nature of its function. Lenses may or may not be needed to focus light; mirrors may or may not be needed to direct light; and additional radiation emitters (lights, bulbs, etc.) may or may not be needed to assure sufficient radiation intensity for imaging by the camera.

The hardware content of the blackjack shoe are available as commercial elements, and include at least the card-reading shoe (disclosed in the U.S. patent applications from which priority has been claimed), network connections for sending the data to a remote location, external processor (such as the mini PC) and reader board/display. The card-reading shoe can be provided as a modular unit that is capable of reading the value of each card being dealt and calculates all of the different card counts of the deck, either internally through its own processor or through a processor in communication linkage with the card-reading shoe. The card count information and other information of interest to casino management can be sent to a remote monitor for viewing by management. The cards are preferably read optically via a camera during the deal, although specialty cards can be used that can be read with magnetic readers, bar code readers, RFID and the like. The camera preferably would be connected to the external processor (e.g., the mini PC) via "FIREWIRE" (IEEE 1394), although USB or wireless communication is possible. The mini PC is connected with the smart shoe via a standard serial port such as RS 232 serial port.

The rules of the game, including the dealing procedures and the card counting methods are programmed into the external processor or mini PC. The program uses these methods to calculate at least one of the following card counts:

Running Card Count—This is an estimate of recent card play only, giving a tendency within play of hitting a patch of ten- and ace-rich or ten- and ace-poor cards.

True Card Count—This is an accurate measure of the total play of ten- and ace-count cards that have been used, and a shift in the percentage of available ten- and ace-count cards (from the absolute 50% available before any cards are displayed or used.

Ace Count—The shortage or excess of aces left in the shoe.

House Advantage—This is based upon a statistical analysis based upon the exact deck composition of cards remaining in the shoe and house rules.

All of this information is sent to the display that may be viewable by the house, but not by players at the game table. The display may or may be viewable by the security staff, usually at the back of the casino in a surveillance area.

The blackjack shoe system will have either an internal processor or remote processor. In either situation, the camera and/or shoe is able to communicate with the processor in order to determine winning hands and record dealing activity. Currently, the system uses TCP/IP as the networking method. Other networking methods can be used.

The card delivery system is also able to transmit some or all of the information to a remote location through its network connection. Some of those transmissions may be encrypted and/or time delayed for security reasons.

The blackjack-dealing unit is a modular element that can be moved from table to table and be integrated with other modules. The shoe, in conjunction with other modules, acts as an intelligent system that works with games that involve decision making or strategies, recording and verifying various game activities.

For example, by adding a dealer card present sensor, the system is able to determine the initial two cards of each player position. By also adding a card-reading discard tray, the composition of each hand can be determined. Other modular units such as bet sensors, round counters, chip reading trays, and the like may also be integrated into the system.

There are a number of independent and/or alternative characteristics of the delivery shoe that are believed to be unique in a device that does not shuffle, sort, order or randomize playing cards.

1) Shuffled cards are inserted into the shoe for dealing and are mechanically moved through the shoe but not necessarily mechanically removed from the shoe.
2) The shoe may optionally mechanically feed the cards (one at a time) to a buffer area where one, two or more cards may be stored after removal from a card input area (before or after reading of the cards) and before delivery to a dealer-accessible opening from which cards may be manually removed.
3) An intermediate number of cards are positioned in a buffer zone between the input area and the removal area to increase the overall speed of card feeding with rank and/or suit reading and/or scanning to the dealer.
4) Sensors indicate when the dealer-accessible card delivery area is empty and cards are automatically fed from the buffer zone (and read then or earlier) one at a time.
5) Cards are fed into the dealer shoe as a vertical stack of face-down cards, mechanically transmitted approximately horizontally, read, and driven into a delivery area where cards can be manually removed.
6) Sensors detect when a card has been moved into a card-reading area. Signal sensors can be used to activate the card-reading components (e.g., the camera and even associated lights) so that the normal symbols on the card can be accurately read.

With regard to triggering of the camera, a triggering mechanism can be used to set off the camera shot at an appropriate time when the card face is expected to be in the camera focal area. Such triggers can include one or more of the following, such as optical position sensors within an initial card set receiving area, an optical sensor, a nip pressure sensor (not specifically shown, but which could be within either nip roller (e.g., 16 or 17) and the like. When one of these triggers is activated, the camera is instructed to time its shot to the time when the symbol-containing corner of the card is expected to be positioned within the camera focal area. The card may be moving at this time and does not have to be stopped. The underlying function is to have some triggering in the device that will indicate with a sufficient degree of certainty when the symbol portion of a moving or moved card will be within the camera focal area. A light associated with the camera may also be triggered in tandem with the camera so as to extend the life of the light and reduce energy expenditure in the system.

The shoe for use with the game of blackjack may be integrated with other components, subcomponents and systems that exist on casino tables for use with casino table games and card games. Such elements as bet sensors, round sensors, card-reading discard racks, progressive jackpot meters, play analysis systems, wagering analysis systems, player comping systems, player movement analysis systems, security systems, and the like may be provided in combination with the blackjack shoe and system described herein. Newer formats for providing the electronics and components may be combined with the blackjack system. For example, new electronic systems used on tables that provide localized or "distributed" intelligence to enable local components to function without absolute command by a central computer are desirable.

The concept of operative control among processing units should be recognized to appreciate the performance of the present invention as well as to comprehend differences between the practice of the present invention and conventional processing apparatus used in the gaming industry. The most important concept is that all existing systems perform by a single main processor sending commands to peripherals to perform specific functions. For purposes of discussion, the initial main emphasis of the description will be directed toward the performance of a casino table card game gaming apparatus. This emphasis is not intended to narrow the scope of the invention, but is rather intended to simplify the description.

The systems in live gaming table systems tend to be structured in the same manner as the slave-master formats of slot machine devices, with systems described as comprising a main computer, central computer or the like, and various peripherals such as card readers, chip readers, cameras, lighting elements, shufflers, bet sensors, movement sensors, motion sensors, jackpot incrementers/decrementers, game status indicators (e.g., jackpot registers, blackjack indicators, symbol indicators and the like) and any other elements of the table game.

Even where there is some processing intelligence distributed around a prior art gaming table, the underlying operation of the system remains a command and response structure, both requiring high component costs limiting the operation of the system. A gaming system with different architectural structure would be desirable if it could reduce costs and add flexibility to the system and enable ease of component replacement.

Multiple intelligent data collection modules acting as finite state machines are each communicatively interconnected with a sensing device to collect data, date stamp the data and send it to a central data repository via a network. The processing unit, referred to in this application as a "G-Mod" in one example of the invention, is a microprocessor with associated memory that is capable of being programmed. In another form, the G-Mod is hard-wired as an FPGA (field-programmable gate array). The G-Mod performs data acquisition, date stamps and sends sensed data via a network such as an Ethernet to an external computer that contains a database. In contrast to systems that provide an exclusive main computer to command all or most individual sensors and peripherals, in the presently described technology, the G-Mod detects activity in the sensors and peripherals. The G-Mod date stamps and broadcasts the information over an Ethernet to a central database. One preferred mode of communication is User Datagram Protocol (UDP), but others such as TCP and TCP/IP are alternative communication protocols. In a preferred form of the invention, the G-Mod broadcasts information over a network but does not cause other G-Mods to perform operations. Less powerful techniques (as compared to typical main processor systems used in gaming apparatus) may be distributed to monitor each peripheral. The use of these separate intelligences for each peripheral (also referred to as a "module") eliminates the need to reprogram old modules as new modules are added, and allows a manufacturer to offer customized hardware and software packages capable of collecting only the information that the casino operator wants to collect.

The intelligent shoe of the present invention can be in communication with a G-Mod, which date stamps and sends all collected data over a network to a database on a remote server.

Casino table card games can be provided with a wide variety of sensors. One such sensor is for detection of an indicator initiated by a dealer to indicate approximate beginner or final completion of a round of play of a casino table card game. The sensor is read by the distributed intelligence table subcomponent (a G-Mod) that has a time/dating capability. The signal is time/date stamped (referred to herein as "Date Stamping" or "date stamping" for simplicity). The date-stamped data is then transmitted generally through a communication line to an external computer that contains database management software and a database interface. The data can be accessed by programs used to analyze the data, if needed. The database interface allows casino management to extract the data in a usable form. The collected data retains its date stamping at least through storage, analysis, data entry or other treatment of the data after transmission away from the table, and the date stamping is typically provided by the separate intelligence, although in some cases, may or may not be provided by the sensor itself.

The components of a casino table gaming apparatus might include a coin acceptor, bill validator, a drop box capable of sensing the input of currency, ticket in/ticket out sensing/reading, lighting, video displays, card-reading sensors, chip counters, security sensing, dealer input controls, player input controls, dealer identification card scanning, player tracking, round counting, hand counting, shuffle counting, and the like. In the present technology described herein, a round counting system is also described, wherein the number of rounds of plays are determined (one round at a time) by a determination of when a dealer's play has been completed, as by complete removal of cards from the dealer's position.

In the practice of the present invention, communication to a data collection system with at least some peripherals is performed by general broadcast communication of game status (which may also be referred to as "generated information or data") over a table-specific network, from more than one distributed intelligence source within the system, each of which is associated with at least one peripheral. Each distributed intelligence (a local processor) sends its own game status communication over the network, but does not respond to game status information of other G-Mods. Each local processor (hereinafter "G-Mod") is capable of sending date-stamped information to a database where the information is stored and can be accessed by the same computer that holds the database or by another external computer. This is a significant element in the practice of the invention, that information may be generally sent (essentially at the same time as a single, generally dispersed signal) over a network from multiple distributed intelligences.

In one form of the invention, the state of each G-Mod is broadcast over a network that contains all of the sensors and G-Mods associated with one gaming table. As the state of each G-Mod changes, the signals being broadcast to all of the G-Mods is changed, and each G-Mod independently transmits information to the central data collection point. G-Mods broadcast and receive state information from other G-Mods, but do not issue commands.

One conceptual way of visualizing or understanding a method of implementing an intelligence system for operation of a gaming system according to the present invention is to break down the tasks of previous constrained (central processor commanded) systems into orthogonal or unrelated sensing events running on independent processors. The term "orthogonal" for purposes of this disclosure means no commonality in function. The provision of orthogonal or independent intelligence functionality and individual performance capability allows the various system components to operate independently, and timely transfer the date-stamped data to a database for further processing. Such a system functions more efficiently because there is no central processor prioritizing the execution of functions.

As noted above, there are many different elements of the gaming system that can be considered as peripherals. Some more important examples of table game-related peripherals include: bet presence, bet recognition, bet separation, card identification, card tracking, player tracking and employee tracking. Other components might include (in addition to those described above) multimedia processing, stepper motor control, random number generation, I/O detection and response, audio signals, video signals, currency handling, coin acceptors, bill acceptors, paperless transactions, ticket-in and ticket-out crediting, security systems, player accounting functions, door locks, signal lighting (change/assistance), player input (e.g., button controls, joy sticks, touch screens, etc.) and any other functions that may be provided on the gaming apparatus.

The units (which may be elsewhere referred to herein as "gaming modules" or "G-Mods") are operated substantially independently of each other, although some interdependencies could exist. In the event of interdependencies, they are not subject to the classic control model but operate by finite state machine changes that are broadcast and then react with intelligence. For purposes of this disclosure, the term "finite state machine" is a theoretical device used to describe the evolution of an object's condition based on its current state (or condition) and outside influences. The present state of an object, its history, and the forces acting upon it can be analyzed to determine the future state of an object. Each state then may have a "behavior" associated with it. An FSM is a very efficient way to model sequencing circuits. Ultimately, the game is nothing more than a complex sequencing unit, branched as appropriate for the game function. All finite state machines can be implemented as hardware logic circuits, software running on a processor or combinations of the two.

By assigning specific data collection controls to local architecture, the design of the system places system tasks into lower computing power manageable units. The manageable units (e.g., the peripherals) can then each be handled (or small groups handled) by dedicated controller modules. Some design care should be taken to combine control of peripherals under a single intelligence to assure that such accumulating demands for processing power are not being required as to merely reconstruct a main processor in a different physical location within the system. For example, it makes sense to combine the tower light (change/assistance) command control intelligence with other button control signals, even though the result is not a game play function. The intelligence requirement for such an assistance function is so low that its addition to almost any other function, it would be barely noticed. In the distributed intelligence structure, the G-Modules or individual intelligences have enough intelligence on board to handle the details of how the G-Mod itself handles details of operation of the peripheral device.

Although the present invention has been described largely in terms of a single round-counting module that sends date-stamped information to a central database, it is to be understood that multiple modules could be present in one system to send collected data to a data repository. In a preferred form of the invention, the date-stamped data is broadcast over an Ethernet specific to the table game, and that the data in this format is collected and recorded by the central data repository.

For example, a blackjack gaming table that is equipped with a round-counting sensor and G-Mod may also be equipped with a sensor at the output of the dealing shoe for counting cards dispensed from the shoe. This information can be used in combination with the round-counting information to deduce the number of hands dealt in a given round of play, and the number of cards dealt per round. If there are bet-presence sensors (and associated G-Mod(s)) for bet sensing, the number of cards per hand and the amount of wager per hand can also be determined. The modules may communicate with one another to send date-stamped bundles of information to the database, or may allow one module to influence the operation of another module.

Each G-mod is collecting, date stamping and transmitting data as the data is collected from the table to a central database, but the G-Mods are not sending commands to one another. The database does not issue commands to the G-Mods, except to reset, reboot and send and receive configuration information. In effect, each G-Mod is a freestanding microprocessor that runs independently of any other intelligence, except that it receives limited operational information from the database computer.

A card swipe module could be added to the table system with an associated G-Mod. This G-Mod could not only transmit time-stamped data to the data repository, but could also transmit player I.D. information to the player tracking system residing in the casino computer system.

One or more sensors could sense information transmitted through an output data port of a shuffler, for example, or a keypad control used to issue commands to a shuffler. The shuffler could have its own G-Mod (or the G-Mod functionality could reside in its internal processor) and is capable of transmitting date-stamped information such as number of cards per hand, number of hands per hour, number of cards dispensed per unit time, number of cards re-fed into a continuous shuffler per unit of time, number of promotional cards dispensed per unit of time, etc. At the same time, another indicator attached to a G-Mod could transmit date-stamped data about bonus awards granted at a certain time, and the like. This information could be collected in a central database.

A bet interface module could also be provided. Known collection techniques for wagering data include optical and metal detection type bet-presence sensors for fixed bets, and camera imaging, radio frequency/identification technology, bar code scanning, scene digitizing, laser scanning, magnetic stripe reading, and the like, for measuring the amount of the bet, as well as the presence of the bet. Outputs from these measurement devices are fed through a dedicated G-Mod and the data is date stamped and delivered to the central data depository.

Another possible G-Mod controls a card-reading camera or other sensing device with similar functionality (reading rank and suit of a card, or just rank) located in the card shuffler, the dealing shoe, and the discard tray, above the table or combinations of the above. Information about the specific cards dealt to each player could be obtained from the database by first feeding date-stamped information about cards dealt and returned into the database via the Ethernet.

In one form of the invention, the G-Mod sends date-stamped information to the database and an algorithm residing in the same computer or separate computer uses this information as well as round counting and betting information to determine the composition of a hand of blackjack, for example.

Another G-Mod is in communication with an I.D. system for tracking the movement of employees in and out of the pit or, more preferably, when the dealers arrive at and leave the table. This information is collected and reported by the dealer G-Mod into the database, and then reports can be generated that combine this information with rounds of play per hour to determine which dealers deal the most hands in a given period of time.

It is noteworthy that in a preferred form of the invention, all of the G-Mods are in communication with the same database, although separate databases may be established for distinct data sets. Also, data repository does not issue commands to the G-Mods, with the exception of requesting configuration data and resetting/rebooting the G-Mods. The central database merely organizes the data in a manner that allows for easy access by external computers or another application program residing on the same computer as the database. In this respect, the G-Mods are self-executing and do not require central intelligence to perform their individual functions. The data may be analyzed and used to make decisions about awarding redeemable points and free rooms to players, etc., scheduling pit labor, promoting pit personnel, closing and opening tables, determining optimal betting limits for given periods of time and other important managerial functions.

Each G-Mod may be in data communication with an interface device such as one or more specialized circuit boards to allow the data from multiple G-Mods to be fed into a standard port of the computer that serves as the data repository. Also, multiple sensing modules may be fed into a single G-Mod if the particular G-Mod has the capacity to process the extra information.

A software interface can be provided to directly access data in the data repository and to manipulate and organize the data so that it can be output onto a display, written report or formed into a data stream so that the data can be further manipulated. In one example of a software interface program, the operator can obtain reports of rounds of play per hour per actual table, per pit, or per property, as determined by the user.

The information in the form of a data stream may be further analyzed. In one example, the data is fed into a host computer or can be analyzed in the same computer system where the database and interface resides or on a host computer. For example, the data from one or more of the round-counting module, the shoe sensor, the card swipe, card-reading module, the shuffler data port sensor, and the bet interfaces can be used to create a report of rounds played per unit of time, the number of players at the table per unit of time, the number of hands played at each round, the maximum bet per player in a given unit of time, the average bet per player in a unit of time, the number of shuffles per unit of time, the number of cards removed from and placed into the shuffler in a unit of time, hand composition and other information considered important to the casino manager.

Because all of the G-Mods work independently, the casino operator can choose the modules and resulting data that is most important to them for a given environment, and only purchase those modules. For example, one casino might want to reconstruct individual hands, track betting and associate the information with a particular player on a high-stakes table, while tracking only rounds and the identification of the employees on low-stakes games.

By using a modular approach to intelligent data collection, only the equipment and reports that are wanted can be provided at the lowest possible cost. Since none of the G-Mods are issuing direct commands to one another, it is not necessary to rewrite any code when additional modules are added.

The applicants have discovered that there are potential inaccuracies in data that is transmitted prior to date/time stamping. When signals are date/time stamped by the main computer, this is merely indicative of when the signal arrived. Also, by providing the stamping function at a receipt site (such as the main processor or central gaming location), the information is more easily subject to manipulation or change by an operator. Also, when there is a line breakdown (e.g., some casinos may still use telephone line connections, which can be busy or interrupted, or the communication system to the main computer breaks down), the accuracy of the stamping is adversely affected. The value of the data decreases in some necessary transactions and casino oversight if the time data is inaccurate. A gaming system with different architectural structure and informational structure would be desirable if it could reduce these issues.

As noted earlier, round counting is one service or data component that can be important to a table. For example, round completion can be important for evaluating rates of play at tables, player rate performance, dealer rate performance, and even disputes over time of completion of hands at different tables or different casinos where priority might be an issue (as in competitive events or qualifying events).

Particularly in games where batch shuffling is used, such as poker or even single-deck blackjack, the signal indicating a "round" could also be originated by cards being placed in a shuffler and a shuffling process initiated, the shuffler sending a start-shuffling signal to the date-stamping component on the table. The dealer could even activate or press a button provided on the table, but this would tend to leave the results under the control of the dealer, which could be manipulated by the dealer to improve results on dealer play, or the dealer could suffer from forgetfulness.

These latter systems, unless they are completely electronic without any physical implementation (such as physical playing cards, dice, spinning wheel, drop ball, etc.) will need sensing and/or reading equipment (e.g., card reading for suits and/or rank, bet-reading sensors, ball-position sensors, dice-reading sensors, player card readers, dealer-input sensors, player-input systems, and the like. These would be the peripherals in the table systems. Also, newer capabilities are enabled such as moisture detection (e.g., for spilled drinks), smoke detection, infrared ink detection (to avoid card marking), shuffler operation, dealer shoe operation, discard rack operation, jackpot meters, side bet detectors, and the like.

What is claimed:

1. A casino table card game playing system for use in playing the casino table card game of blackjack, the system comprising:

a display screen; and a playing card delivery shoe for dealing playing cards, the playing card delivery shoe comprising:

an area for receiving a set of playing cards useful in the play of the casino table card game of blackjack;

a first playing card mover for moving only one playing card at a time from the set of playing cards to a playing card staging area for staging at least one playing card in an order;

a second playing card mover for moving only one playing card at a time from the playing card staging area to a playing card delivery area in the same order by which the playing cards are moved from the set of playing cards to the playing card staging area;

at least one playing card reading sensor positioned to read at least one playing card value of each playing card separately before each playing card becomes stationary in the playing card delivery area; and a processor in communication with the at least one playing card reading sensor, the processor programmed to determine the at least one playing card value of each playing card and to process game-related information for display on the display screen.

2. The system of claim 1, wherein at least one playing card but less than an entire deck of playing cards is present in the playing card staging area at any given time during operation of the system.

3. The system of claim 2, wherein from one to two playing cards are present in the playing card staging area at any given time during operation of the system.

4. The system of claim 1, wherein the game-related information relates to a composition of playing cards remaining in the playing card delivery shoe.

5. The system of claim 1, wherein the game-related information is selected from the group consisting of: cut card presence, stop card delivery state, door open, misdeal, continue to deal, stop card delivery routine, deck verified, supervisor swipe, continue to deal, hand outcome, player instructions, history of player hand results, game outcome, game rules, hand count, advertising, player announcements, deck counts, running card count, true card count, ace card count, and house advantage.

6. The system of claim 1, further comprising a system of comparison programmed to compare the value of the at least one playing card read by the at least one playing card reading sensor with stored values of playing cards to determine playing cards remaining in the playing card delivery shoe.

7. The system of claim 1, wherein the display screen is remote from the playing card delivery shoe.

8. The system of claim 1, further comprising a card-reading discard rack and a dealer round count indicator, the card-reading discard rack and dealer round count indicator in communication with a processor external to the playing card delivery shoe, the processor external to the playing card delivery shoe programmed to process data from the card-reading discard rack and the dealer round count indicator to provide information relating to hand composition and historical events of game play for display on the display screen.

9. The system of claim 1, further comprising a G-Mod in communication with the playing card delivery shoe, wherein the G-Mod is configured to send data collected from the at least one playing card reading sensor to an external processor via a network connection.

10. The system of claim 1, wherein the processor is communicatively linked with the display screen and configured to receive information from the playing card delivery shoe relating to at least card rank and configured to provide the display screen with card rank display information for playing cards dealt during a round of play of blackjack.

11. The system of claim 1, wherein the processor is configured to cause the display screen to display a house advantage.

12. The system of claim 1, wherein a section of the display screen provides streaming video unrelated to immediate play of the casino table card game.

13. A blackjack gaming system, comprising:

a processor;

a display panel in communication with the processor; and a card dealing shoe for use in playing the casino table card game of blackjack in communication with the processor, the card dealing shoe comprising:

a card infeed area where an approximately vertical set of playing cards with one major surface up and with one major surface down can be seated;

a playing card moving element that moves only one playing card at a time from the approximately vertical set of playing cards;

a buffer area between the card infeed area and a playing card delivery area of the card delivery shoe, the buffer area being an area where, during operation of the system, at least some playing cards remain stationary for a time before being delivered to the playing card delivery area;

an automatic mechanical transporting system for horizontally transporting only one playing card at a time moved from the vertical set of playing cards to the playing card delivery area of the card dealing shoe; and a playing card reading system positioned to read at least a value of the playing cards before the playing cards become stationary in the playing card delivery area of the card dealing shoe, the playing card reading system positioned in the buffer area between the card infeed area and the playing card delivery area of the card dealing shoe;

wherein the display panel is configured to display information relating to the game of blackjack based on the value of playing cards read by the playing card reading system.

14. The system of claim 13, wherein only one playing card is present in the buffer area at any time during operation of the system.

15. The system of claim 13, wherein the playing card reading system is positioned to read playing cards as the playing cards enter the buffer area or when the playing cards are fully within the buffer area.

16. The system of claim 13, further comprising a communication link between the playing card reading system and the processor, wherein the processor is configured to process at least one of the following forms of information: cut card presence, stop card delivery state, door open, misdeal, deck verified, supervisor swipe, continue to deal, stop card delivery routine, hand outcome, player instructions, history of player hand results, game outcome, game rules, hand count, advertising, player announcements, deck counts, running card count, true card count, ace card count and house advantage.

* * * * *